US011773611B1

(12) United States Patent
Fineran et al.

(10) Patent No.: US 11,773,611 B1
(45) Date of Patent: Oct. 3, 2023

(54) PROTECTIVE ROOF TARP AND ASSOCIATED METHODS

(71) Applicant: Storm Damage Solutions, LLC, Ponte Vedra Beach, FL (US)

(72) Inventors: Stephen Fineran, Ponte Vedra Beach, FL (US); Michael Nichols, Miami, FL (US)

( * ) Notice: Subject to any disclaimer, the term of this patent is extended or adjusted under 35 U.S.C. 154(b) by 4 days.

(21) Appl. No.: 17/465,805

(22) Filed: Sep. 2, 2021

Related U.S. Application Data

(60) Provisional application No. 63/073,753, filed on Sep. 2, 2020.

(51) Int. Cl.
*E04G 23/02* (2006.01)
*E04D 5/06* (2006.01)
*E04D 5/12* (2006.01)

(52) U.S. Cl.
CPC ..... *E04G 23/0281* (2013.01); *E04D 5/06* (2013.01); *E04D 5/12* (2013.01)

(58) Field of Classification Search
CPC ..... E04G 21/241; E04G 21/242; E04G 21/28; E04G 21/30; E04G 2021/248; E04G 23/0281
See application file for complete search history.

(56) References Cited

U.S. PATENT DOCUMENTS 2,705,209 A * 3/1955 Rowe ..... E04D 5/148 428/101
3,483,664 A * 12/1969 Malone, Jr. ..... E04D 13/16 428/317.1
3,862,876 A * 1/1975 Graves ..... E04G 21/28 47/9
4,249,589 A * 2/1981 Loeb ..... E06B 3/285 160/354
4,386,136 A * 5/1983 Kaufmann ..... E04D 13/002 428/451

(Continued)

FOREIGN PATENT DOCUMENTS

DE 10137672 A1 * 3/2002 ..... E04D 13/12
DE 202008000132 U1 * 6/2008 ..... E04G 21/28

(Continued)

OTHER PUBLICATIONS www.UTARPIT.com from WayBack Machine—clipped fro May 30, 2019 (Year: 2019).*

(Continued)

*Primary Examiner* — Ryan D Kwiecinski
(74) *Attorney, Agent, or Firm* — Ashkan Najafi

(57) ABSTRACT

A protective roof tarp includes deformably pliable adhesive tape(s) configured to maintain continuous adhesion (e.g. surface area contact) to both barrel-shaped roof tile as well as planar-shaped roof tile having granules attached to a top surface thereof such that adhesive material penetrates past the granules and engages a roof tile substrate therebeneath for effectively prohibiting water from flowing beneath the protective tarp, and onto the roof file, during extended periods of time and in inclement weather conditions. A protective roof tarp kit can include a heat-shrinkable tarp, double-sided adhesive tape, single-sided adhesive tape, and a cutting implement.

18 Claims, 46 Drawing Sheets

(56) References Cited

U.S. PATENT DOCUMENTS 4,468,422 A * 8/1984 Siener, Jr. ..... E04D 5/10 428/408
4,682,447 A * 7/1987 Osborn ..... A01G 20/43 383/4
4,996,801 A * 3/1991 Ristow ..... E04D 13/1415 52/273
5,038,889 A * 8/1991 Jankowski ..... G09F 19/226 182/138
5,345,989 A * 9/1994 Brophy ..... E04G 21/241 160/354
5,447,006 A * 9/1995 Zenor ..... E04D 5/149 52/514
5,629,064 A * 5/1997 Sherman ..... E04G 21/30 52/390
5,685,112 A * 11/1997 Fara ..... E04G 21/32 52/745.15
5,819,474 A * 10/1998 Strom ..... E04H 15/34 52/63
5,937,596 A * 8/1999 Leeuwenburgh ..... E06B 3/285 160/354
7,285,172 B2 * 10/2007 Martin ..... B08B 15/04 134/4
7,299,588 B2 * 11/2007 Diaz ..... E04G 21/28 52/3
7,445,676 B2 * 11/2008 Martin ..... E04G 23/08 134/4
7,793,478 B2 * 9/2010 Ehsani ..... E04D 5/148 52/409
7,818,941 B2 * 10/2010 Freudenberg ..... B08B 15/00 160/405
8,709,565 B2 * 4/2014 Kalwara ..... E04D 5/148 52/309.1
8,984,815 B1 * 3/2015 LaFour ..... E04G 21/28 52/506.04
9,797,154 B1 * 10/2017 McKinney ..... E04H 15/54
9,822,536 B2 * 11/2017 Lennox ..... E04G 21/28
10,100,573 B2 * 10/2018 Mendoza ..... E06B 5/14
10,246,889 B1 * 4/2019 Nogueras ..... E04G 21/28
10,385,572 B2 * 8/2019 Granovsky ..... E04D 12/002
10,472,827 B1 * 11/2019 Mouriz ..... E04G 21/28
10,683,666 B1 * 6/2020 Mouriz ..... E04D 5/146
10,844,603 B2 * 11/2020 Egan ..... E04D 5/06
10,851,546 B2 * 12/2020 Mouriz ..... E04D 5/06
10,863,675 B2 * 12/2020 Reed ..... A01F 25/13
11,041,312 B2 * 6/2021 Mouriz ..... E04G 21/24
11,230,091 B2 * 1/2022 Whittemore ..... E06B 9/0692
2002/0095898 A1 * 7/2002 Bettencourt ..... E04G 21/28 52/506.01
2003/0070391 A1 * 4/2003 Tachauer ..... E04D 5/147 52/506.05
2004/0188008 A1 * 9/2004 Robison ..... E04D 15/04 156/271
2004/0221940 A1 * 11/2004 Harte ..... C09J 7/22 156/247
2005/0217202 A1 * 10/2005 Crook ..... E04H 9/14 52/782.1
2006/0010815 A1 * 1/2006 Dixon ..... E04G 21/28 52/514
2006/0150537 A1 * 7/2006 Baum ..... E04G 21/28 52/90.1
2006/0210753 A1 * 9/2006 Kadlec ..... B32B 21/10 428/41.8
2007/0193122 A1 * 8/2007 Diaz ..... E04G 21/28 52/3
2007/0266645 A1 * 11/2007 Diaz ..... E04G 21/28 52/23
2007/0266660 A1 * 11/2007 Davies ..... F24S 25/61 52/309.1
2008/0148669 A1 * 6/2008 Ehrman ..... E04G 23/02 52/514
2008/0209835 A1 * 9/2008 Margarites ..... E04G 23/02 52/518
2009/0178346 A1 * 7/2009 Diaz ..... E04G 21/28 52/3
2010/0154943 A1 * 6/2010 Langer ..... E04G 21/30 150/154
2011/0107685 A1 * 5/2011 Hasan ..... E04D 13/155 52/745.21
2012/0244315 A1 * 9/2012 Barrego ..... E04G 21/28 428/141
2018/0291675 A1 * 10/2018 Whittemore ..... E04G 21/241
2019/0085572 A1 * 3/2019 Rus ..... E04G 21/30
2019/0242153 A1 * 8/2019 MacKarvich ..... E04H 15/60
2020/0056388 A1 * 2/2020 Cohen ..... B60J 7/10
2020/0131774 A1 * 4/2020 Egan ..... E04D 5/06
2020/0347624 A1 * 11/2020 Rus ..... C09J 7/30
2021/0079656 A1 * 3/2021 Mouriz ..... E04G 21/24
2021/0131106 A1 * 5/2021 Arthurs ..... B32B 5/022
2021/0285210 A1 * 9/2021 Gosling ..... E04B 1/681
2021/0324641 A1 * 10/2021 Jimenez ..... E04G 21/28
2022/0064972 A1 * 3/2022 Lennox ..... B29C 66/43

FOREIGN PATENT DOCUMENTS

DE 102013013271 A1 * 2/2015 ..... E04G 21/241
EP 2647778 A2 * 10/2013 ..... B32B 25/00
FR 3051287 A1 * 11/2017 ..... H02B 1/14
FR 3118778 A1 * 7/2022
GB 2432854 A * 6/2007 ..... E04D 1/30
GB 2469830 A * 11/2010 ..... E04D 5/06
WO WO-2007086902 A1 * 8/2007 ..... E04G 21/28
WO WO-2009146487 A1 * 12/2009 ..... E04D 12/002
WO WO-2011023741 A1 * 3/2011 ..... E04D 5/06
WO WO-2016075857 A1 * 5/2016 ..... C08J 11/04

OTHER PUBLICATIONS

Utarpit, www.utarpit.com, utarpit product displayed on website, accessed website on Sep. 1, 2021, USA.

* cited by examiner

PROTECTIVE ROOF TARP AND ASSOCIATED METHODS

CROSS REFERENCE TO RELATED APPLICATIONS

This is a non-provisional patent application that claims priority to and benefit of co-pending U.S. provisional patent application No. 63/073,753 filed Sep. 2, 2020, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to protective roof tarps and, more particularly, to a protective roof tarp that employs deformably pliable adhesive tape(s) configured to maintain continuous adhesion (e.g. surface area contact) to both barrel-shaped roof tile as well as planar-shaped roof tile having granules attached to a top surface thereof such that adhesive material penetrates past the granules and engages a roof tile substrate therebeneath for effectively prohibiting water from flowing beneath the protective tarp, and onto the roof file, during extended periods of time and in inclement weather conditions.

Prior Art

For many years, blue tarps have been the standard product used to protect properties from further damage due to water intrusion from a damaged roof. Unfortunately, such blue tarps have shortcomings, which permit water to pass therebeneath and onto a roof surface. A need was recognized to protect properties in a better way than conventional blue tarps. There are many different types of roofing systems and materials for roofs. For example, shingle, barrel tile, slate, shake, metal, and other materials are used for flat roofing systems.

There are several requirements to adequately protect a property from further water intrusion damage after a roof has been damaged. The first requirement is that the tarp must adequately stop water from entering the damaged/faulty roof. The second requirement is that the tarp must be able to last a long period of time during inclement weather conditions because in many cases it can take months before a new roof can be installed. The third requirement, is that the tarp must be securely attached or fastened to the roof in a manner that restricts movement and prevents the tarp from being blown away due to the inclement weather conditions.

Even though conventional blue tarps have been used to protect properties from further damage for many years, the blue tarp fails in all three categories of the aforementioned requirements. Blue tarps are made by "weaving" plastics together, this causes the blue tarp to be naturally porous. Such blue tarps are traditionally nailed or screwed to wood furring strips attached onto the roof. Unfortunately, such methods penetrate the roofing system and causes more damage. Another method used is placing sandbags on top of the tarp to weigh down the tarp, which is very dangerous and has caused injuries and damage to property from sliding off the roof. Lastly, ropes are used to tie down the tarps.

With the aforementioned inadequacies of blue tarps, there emerged a far superior method to completely protecting properties from further roof damage. The far superior method is using shrink wrap to incapsulate the roof and produce a long-lasting waterproof solution that could be secured around the perimeter of the roof in a way that does to not create more damage to the roof. Once the roof is completely incapsulated, the plastic is heated with heat guns to shrink the plastic to create a secure solid membrane along the roof. After the shrink wrap is completely attached, installers then need to go around the roof to seal around any fixtures on the roof such as vents or chimneys as well as patching any holes created during the installation process.

The method for sealing around roof fixtures and patching shrink wrap holes started with the utilization of shrink wrap tape. After a few months, such shrink wrap tape loses the ability to hold and would start to fail. This failure of the shrink wrap tape put the joint inventors on a journey to find a tape that had the ability to stay attached for at least one year and maintain the integrity of the waterproof shrink wrap system.

The use of shrink-wrap material requires the entire roof to be incapsulated to guarantee no leaks. Even though the shrink wrap material is not always directly attached to the roof tile, it is attached to the facia or under the soffit and therefore still created damage from the nails or screws. The amount of equipment and supplies required to install the shrink wrap was extensive, for example screws, screw guns, furring strips, electric saws to cut the furring strips, concrete nail guns, propane heat guns, propane tanks, etc. The manpower needed to shrink wrap a roof may be a minimum of four installers because the sheets of plastic are very heavy and large, and shrink wrapping is very dangerous due to the size of the plastic sheets, and are heavy and can easily catch the wind. All of these downfalls have caused the roof shrink-wrapping service to be expensive.

Furthermore, prior art tarping system such as www.U-TARPIT.com employ tar as its adhesive. Tar is a flammable and combustible substance made from any of various dark-colored viscid products obtained by the destructive distillation of certain organic substances, as coal or wood. Such tar can be dangerous due to its flammable properties and inability to still to the roof tile (granules) if not heated properly. Such an aforementioned product is created by "weaving" plastic products together. Because of this "weaving" the tarp is naturally porous and fails to completely keep water from penetrating beneath the tarp.

Accordingly, a need remains for a protective roof tile in order to overcome at least one of the above-noted shortcomings. The exemplary embodiment(s) satisfy such a need by a protective roof tarp that employs deformably pliable adhesive tape(s) that is/are convenient and easy to use, lightweight yet durable in design, versatile in its applications, and configured to maintain continuous adhesion (e.g. surface area contact) to both barrel-shaped roof tile as well as planar-shaped roof tile having granules attached to a top surface thereof such that adhesive material penetrates past the granules and engages a roof tile substrate therebeneath for effectively prohibiting water from flowing beneath the protective tarp, and onto the roof file, during extended periods of time and in inclement weather conditions.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a protective roof tarp that employs deformably pliable adhesive tape(s) configured to maintain continuous adhesion (e.g. surface area contact) to both barrel-shaped roof tile as well as planar-shaped roof tile having granules attached to a top surface thereof such that adhesive material penetrates past the granules and engages a roof tile substrate therebeneath for effectively prohibiting water from flowing beneath the protective tarp, and onto the roof file, during extended periods of time and in inclement weather conditions.

These and other objects, features, and advantages of the non-limiting exemplary embodiment(s) are provided by a protective roof tarp for being positioned on top of an existing roof surface. The protective roof tarp includes a single and continuous body having a top face, a bottom face, and a plurality of edges. A first adhesive tape is attached to the bottom face and extended along the edges of the body. Advantageously, the body includes a flexible impermeable sheet configured to be positioned along a top contour of the existing roof surface. Advantageously, the first adhesive tape has a thickness suitably sized and shaped to deformably conform to the top contour of the existing roof surface and thereby prohibit water from accessing the existing roof surface.

In a non-limiting exemplary embodiment, the first adhesive tape is flexible and deformably resilient such that a cross-sectional thickness of the first adhesive tape is decreased when an external force is exerted thereagainst.

In a non-limiting exemplary embodiment, the first adhesive tape includes a plurality of first adhesive tape strips arranged in an end-to-end pattern. Each of the first adhesive tape strips has a longitudinal length less than a longitudinal length of an associated one of the edges.

In a non-limiting exemplary embodiment, the first adhesive tape is spaced inwardly of the edges of the body.

In a non-limiting exemplary embodiment, the first adhesive tape is not visible to a line of sight taken from a top face of the body.

In a non-limiting exemplary embodiment, the first adhesive tape has a top surface attached to the bottom face of the body.

In a non-limiting exemplary embodiment, the first adhesive tape has a bottom surface attached directly to the top contour of the existing roof surface. Advantageously, an entire surface area of the top surface of the first adhesive tape is continuously affixed to the bottom face of the body.

In a non-limiting exemplary embodiment, an entire surface area of the bottom surface of the first adhesive tape is continuously affixed directly to the top contour of the existing roof surface.

In a non-limiting exemplary embodiment, a second adhesive tape is provided and attached to the top surface and extended along the edges of the body. In this manner, the body is intercalated between the first adhesive tape and the second adhesive tape such that the first adhesive tape is spaced from the second adhesive tape.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
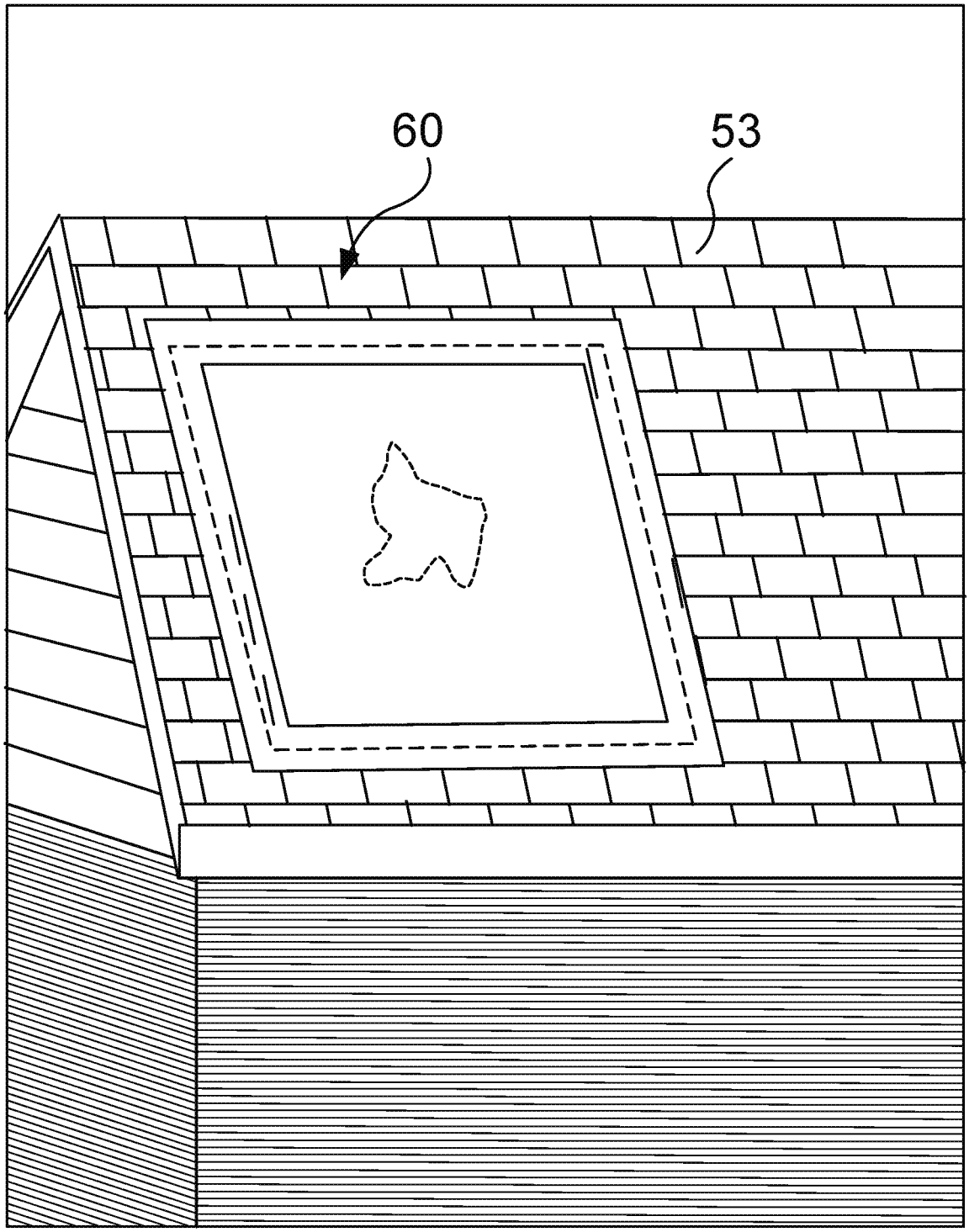
FIG. 1 is a perspective view of the protective roof tarp, in accordance with a non-limiting exemplary embodiment of the present disclosure.
Figure 2:
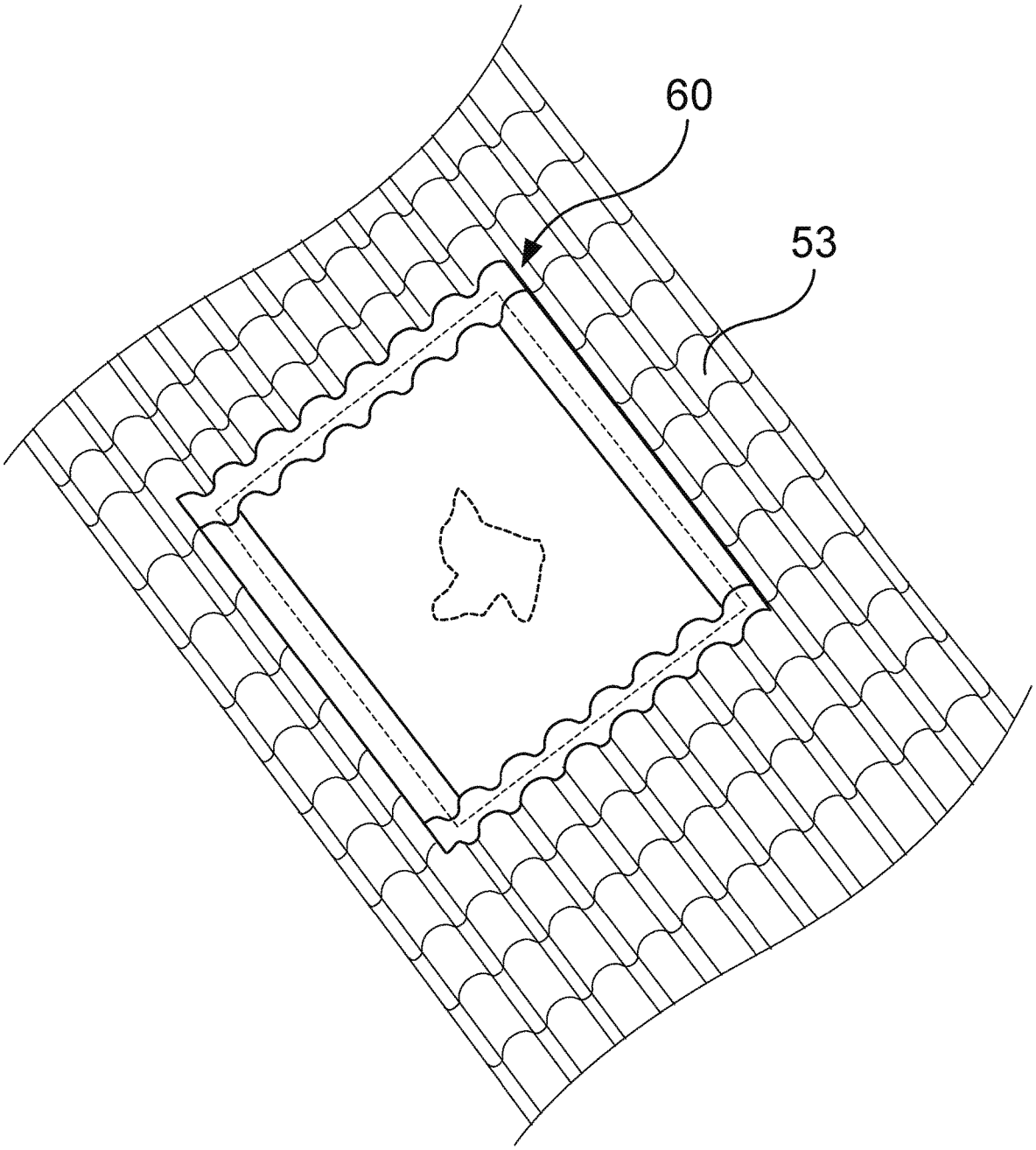
FIG. 2 is a perspective view of the protective roof tarp, in accordance with a non-limiting exemplary embodiment of the present disclosure.
Figure 3:
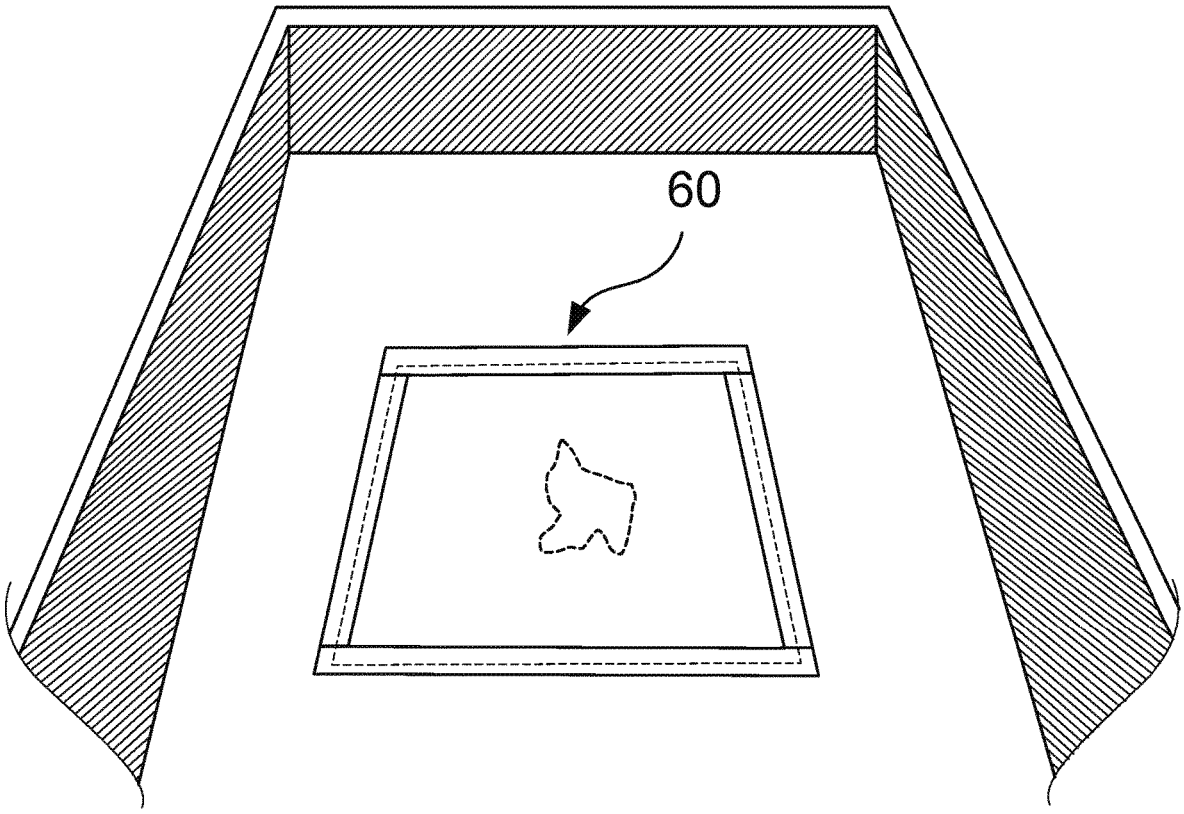
FIG. 3 is a perspective view of the protective roof tarp, in accordance with a non-limiting exemplary embodiment of the present disclosure.
Figure 4:
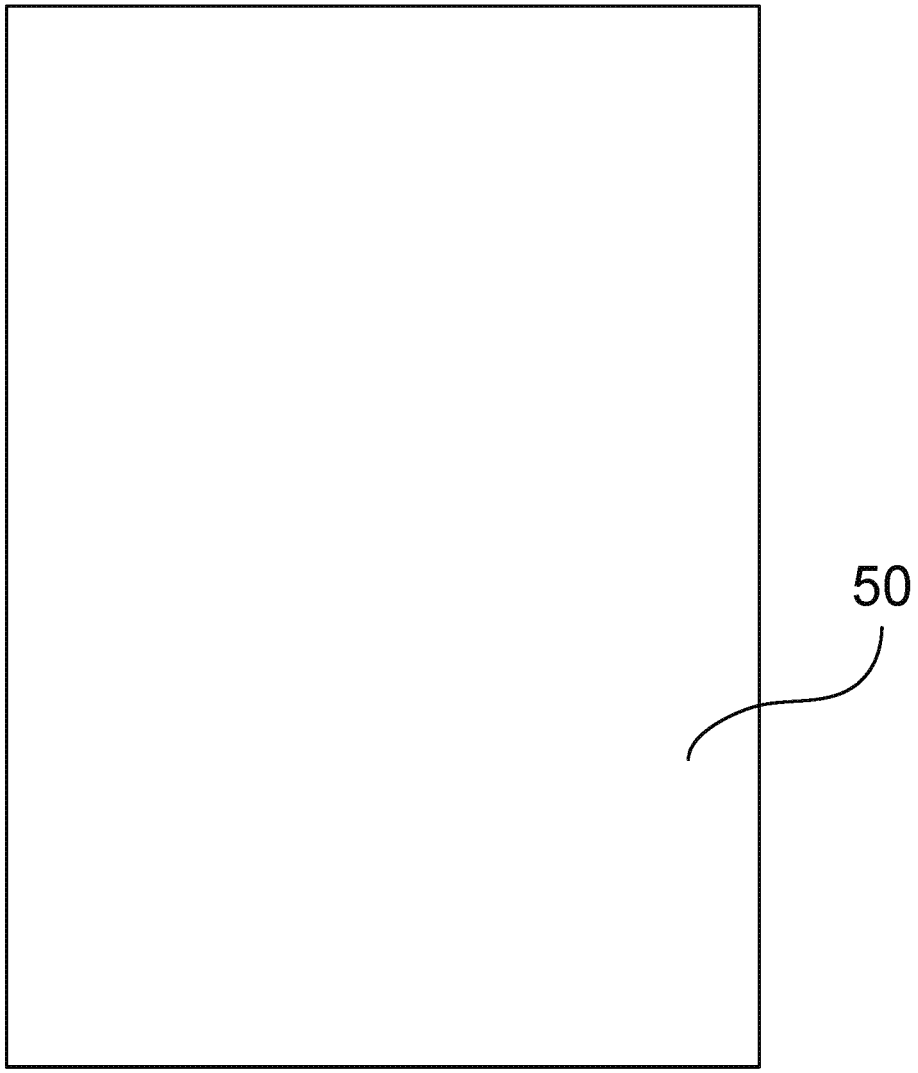
FIG. 4 is a top plan view of the protective roof tarp, in accordance with a non-limiting exemplary embodiment of the present disclosure.
Figure 5:
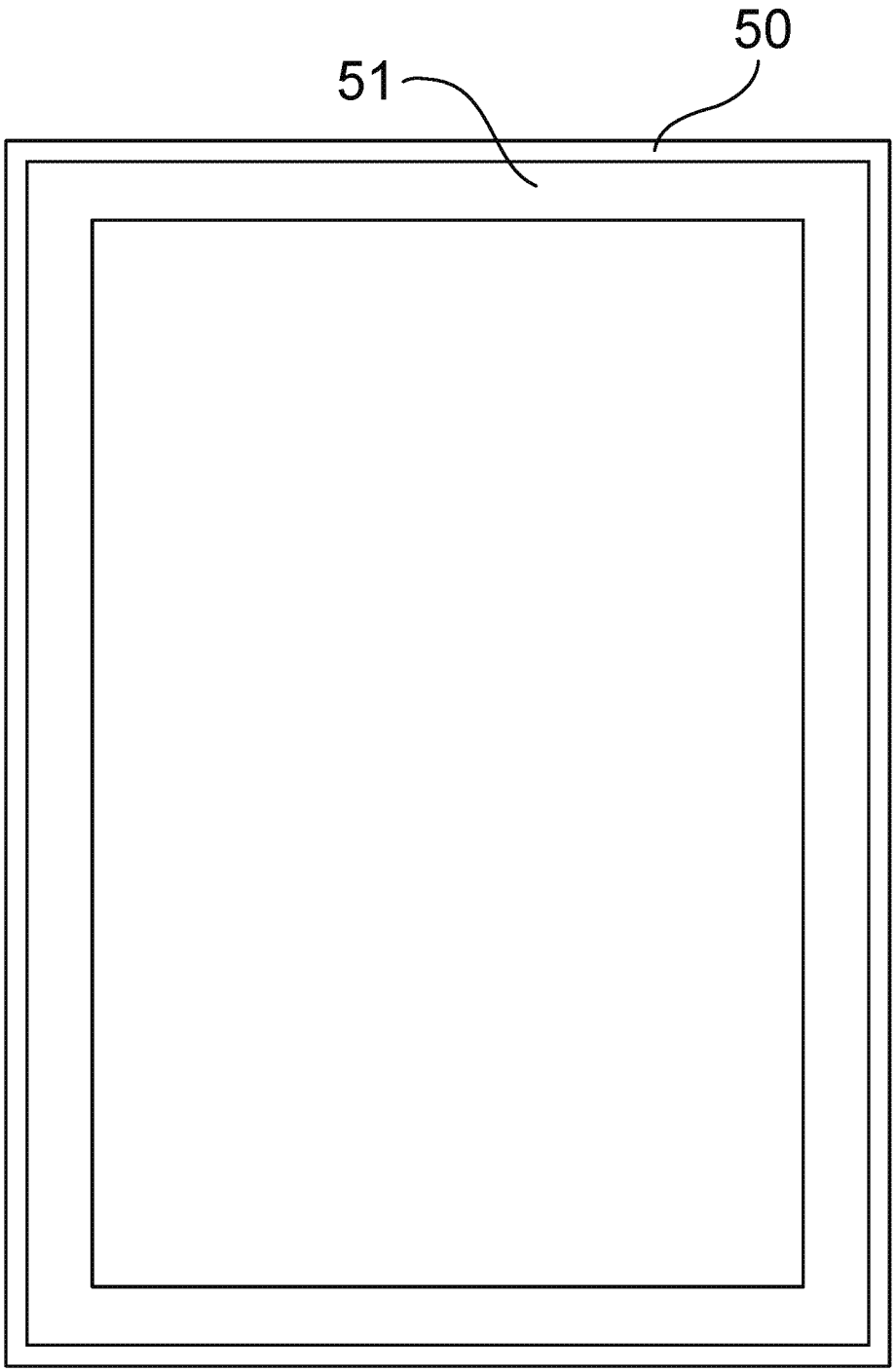
FIG. 5 is a bottom plan view of the protective roof tarp, in accordance with a non-limiting exemplary embodiment of the present disclosure.
Figure 6:
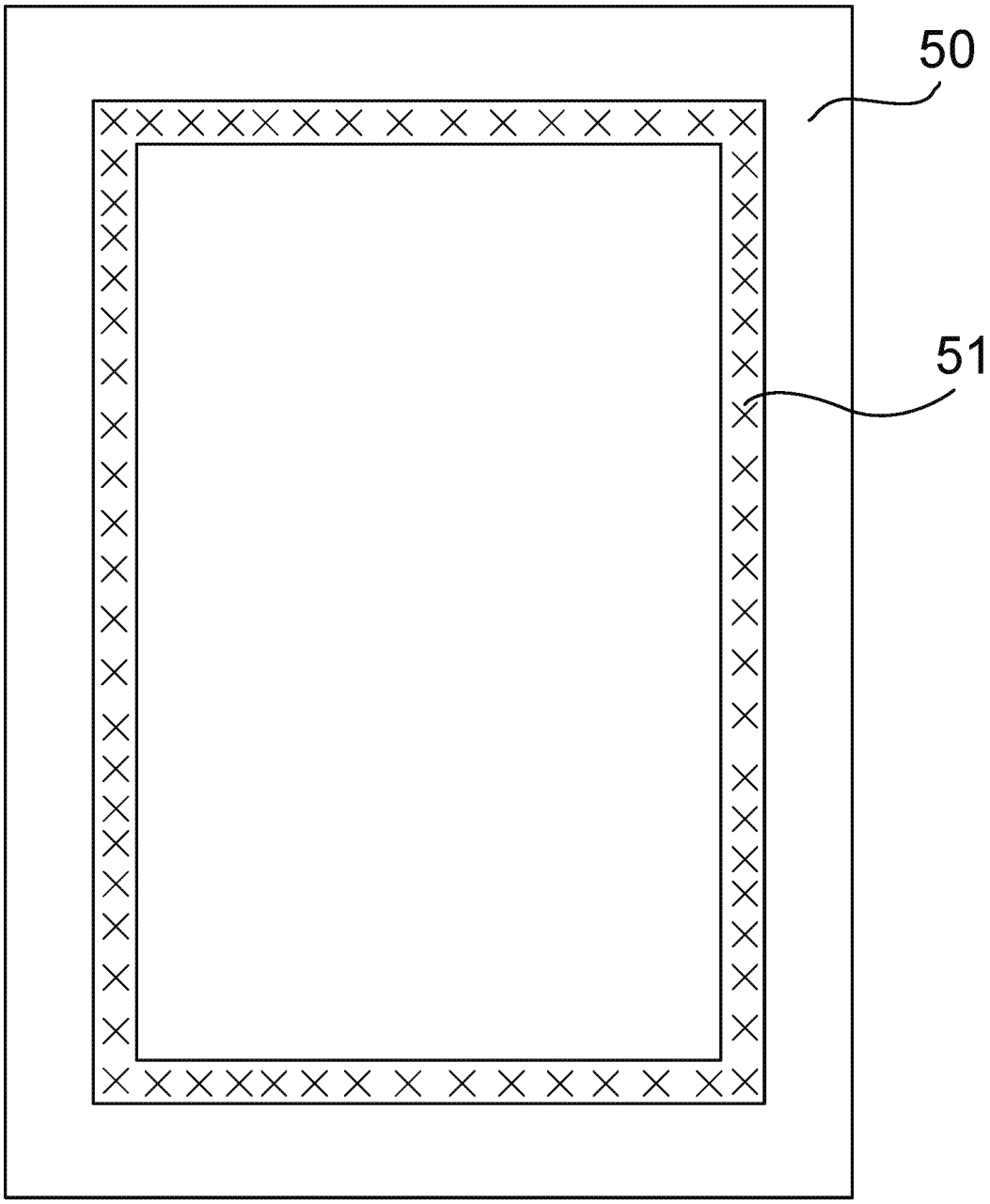
FIG. 6 is a bottom plan view of the protective roof tarp, in accordance with a non-limiting exemplary embodiment of the present disclosure.
Figure 7:
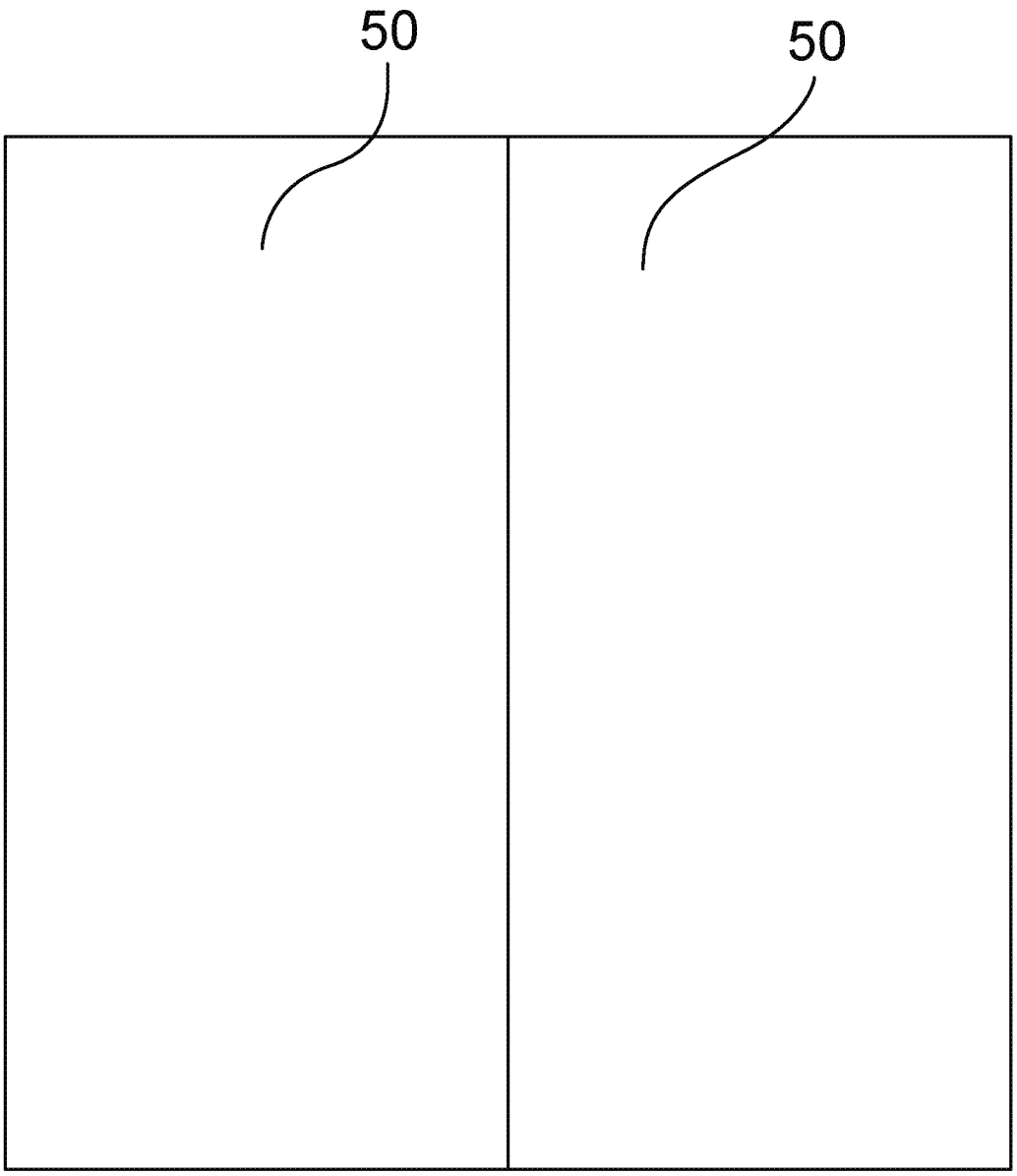
FIG. 7 is a bottom view of the protective roof tarp, in accordance with a non-limiting exemplary embodiment of the present disclosure.
Figure 8:
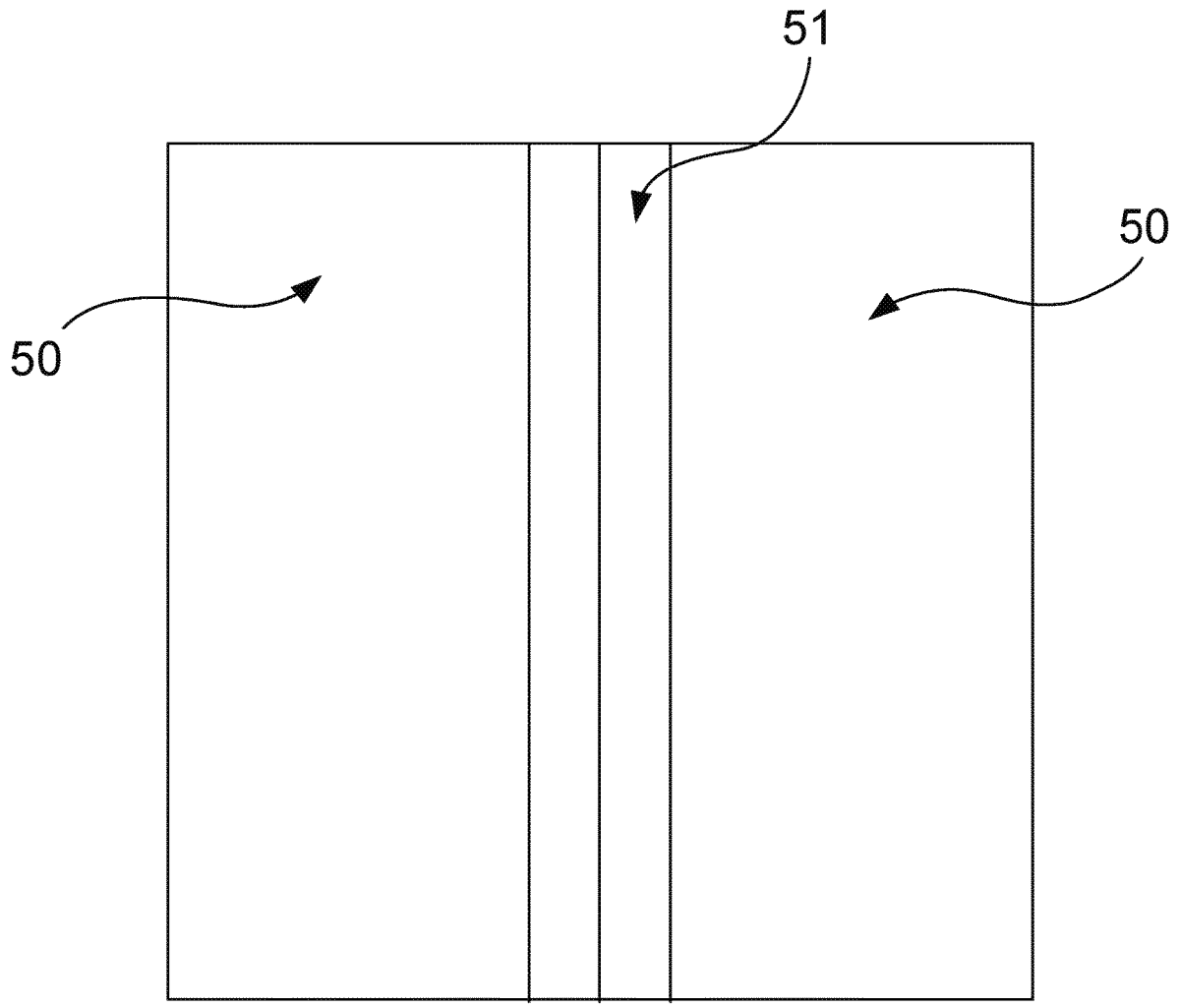
FIG. 8 is a top plan view of the protective roof tarp, in accordance with a non-limiting exemplary embodiment of the present disclosure.
Figure 9:
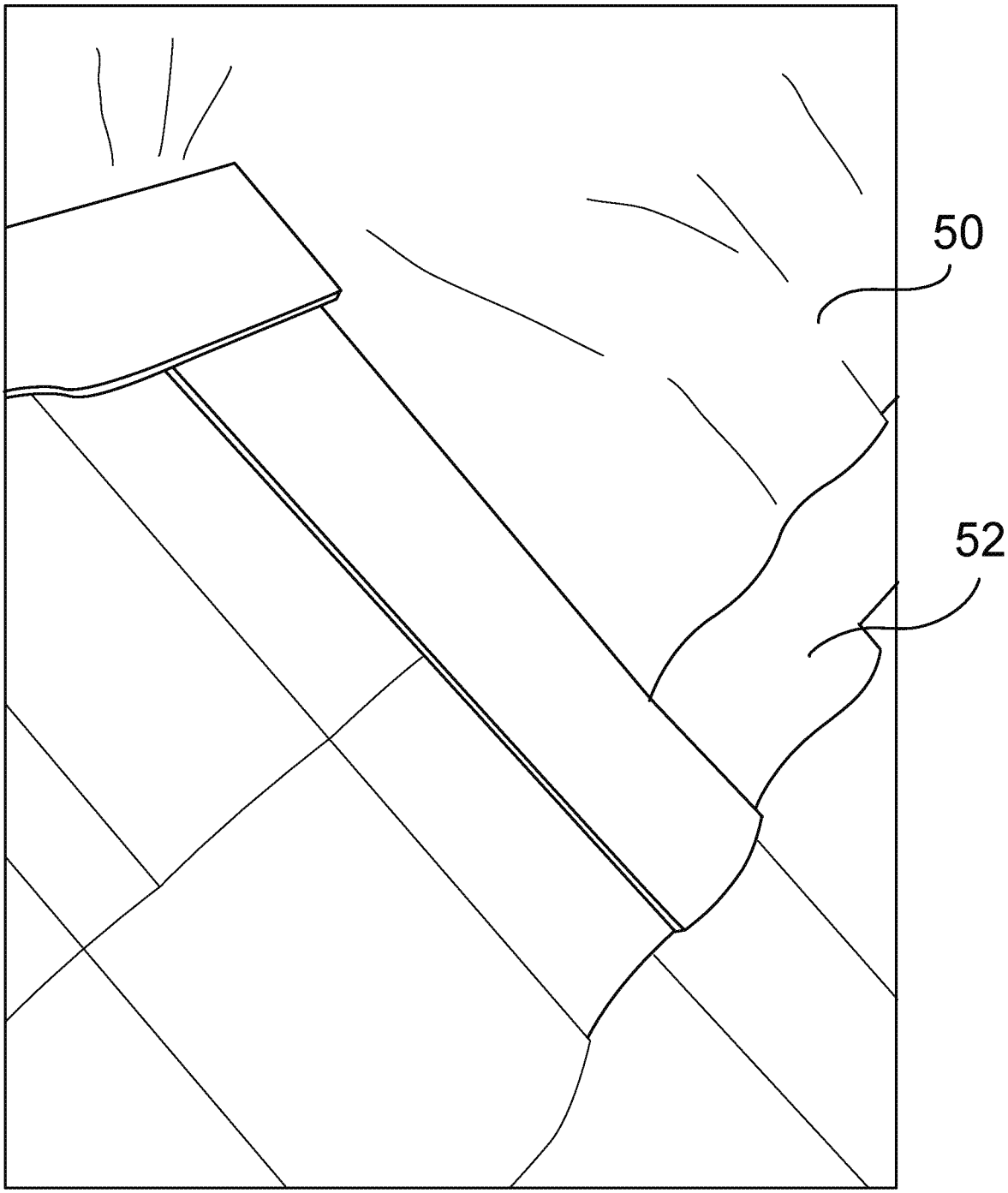
FIG. 9 is a perspective view of the protective roof tarp, in accordance with a non-limiting exemplary embodiment of the present disclosure.
Figure 10:
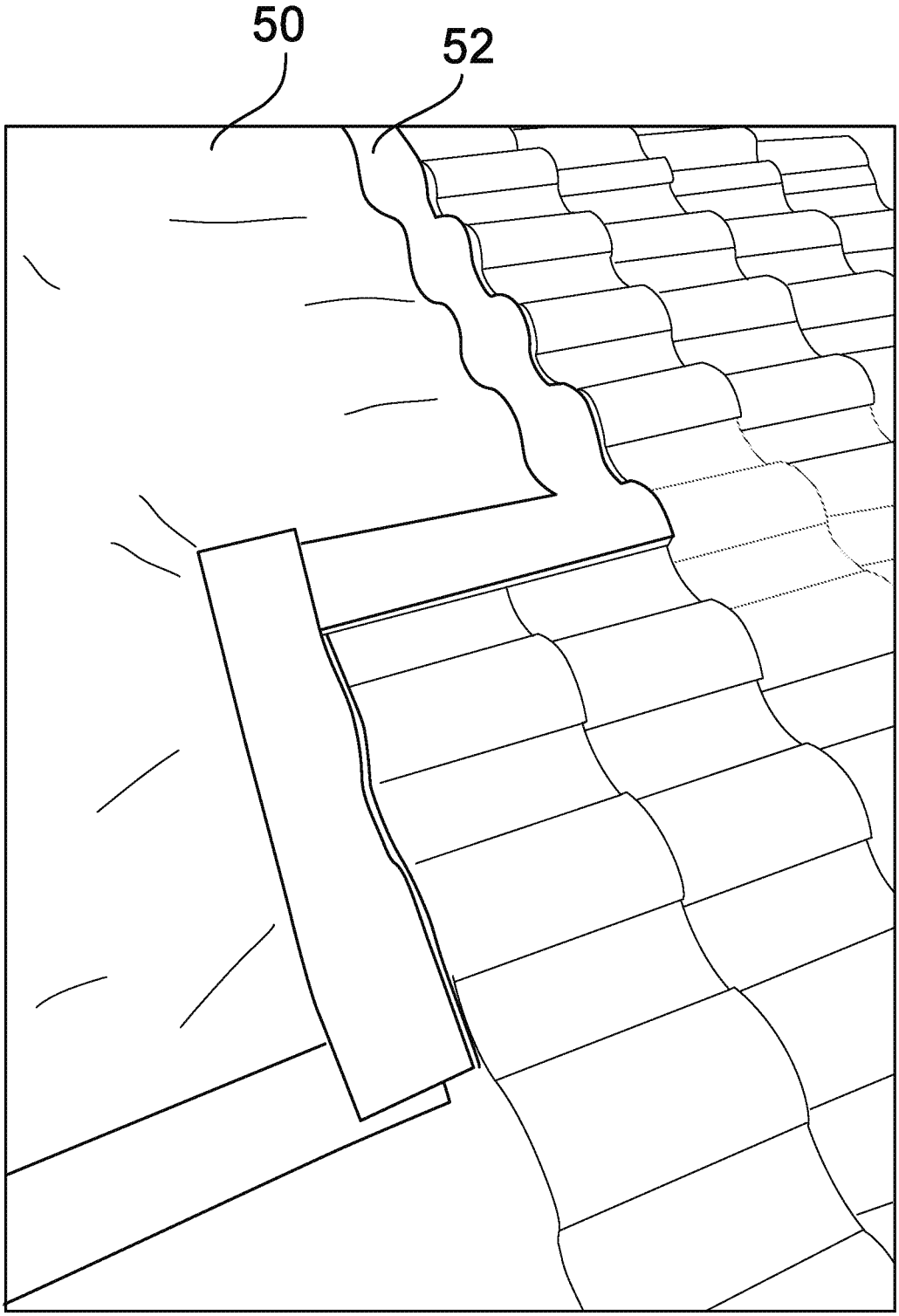
FIG. 10 is a perspective view of the protective roof tarp, in accordance with a non-limiting exemplary embodiment of the present disclosure.
Figure 11:
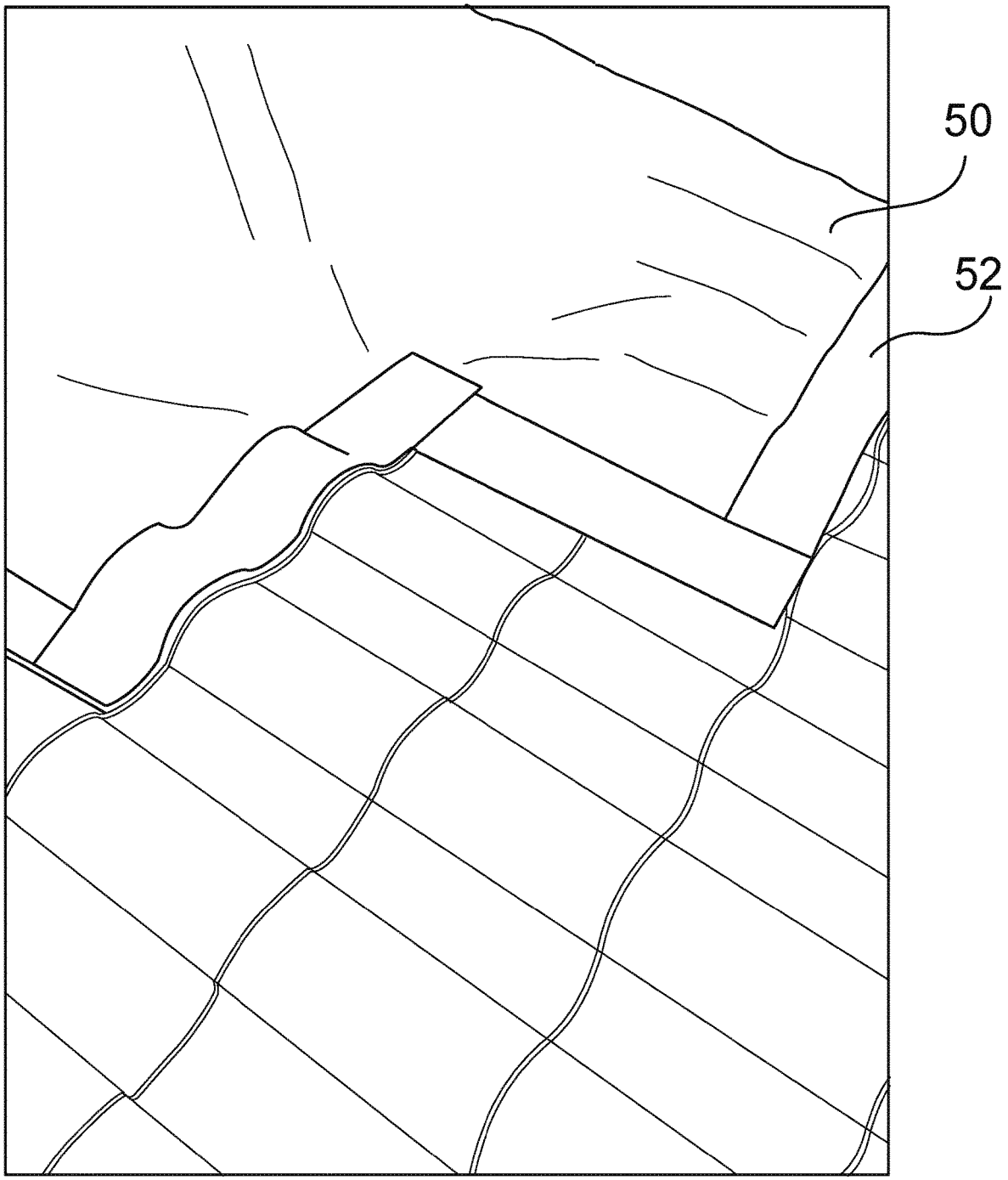
FIG. 11 is a perspective view of the protective roof tarp, in accordance with a non-limiting exemplary embodiment of the present disclosure.
Figure 12:
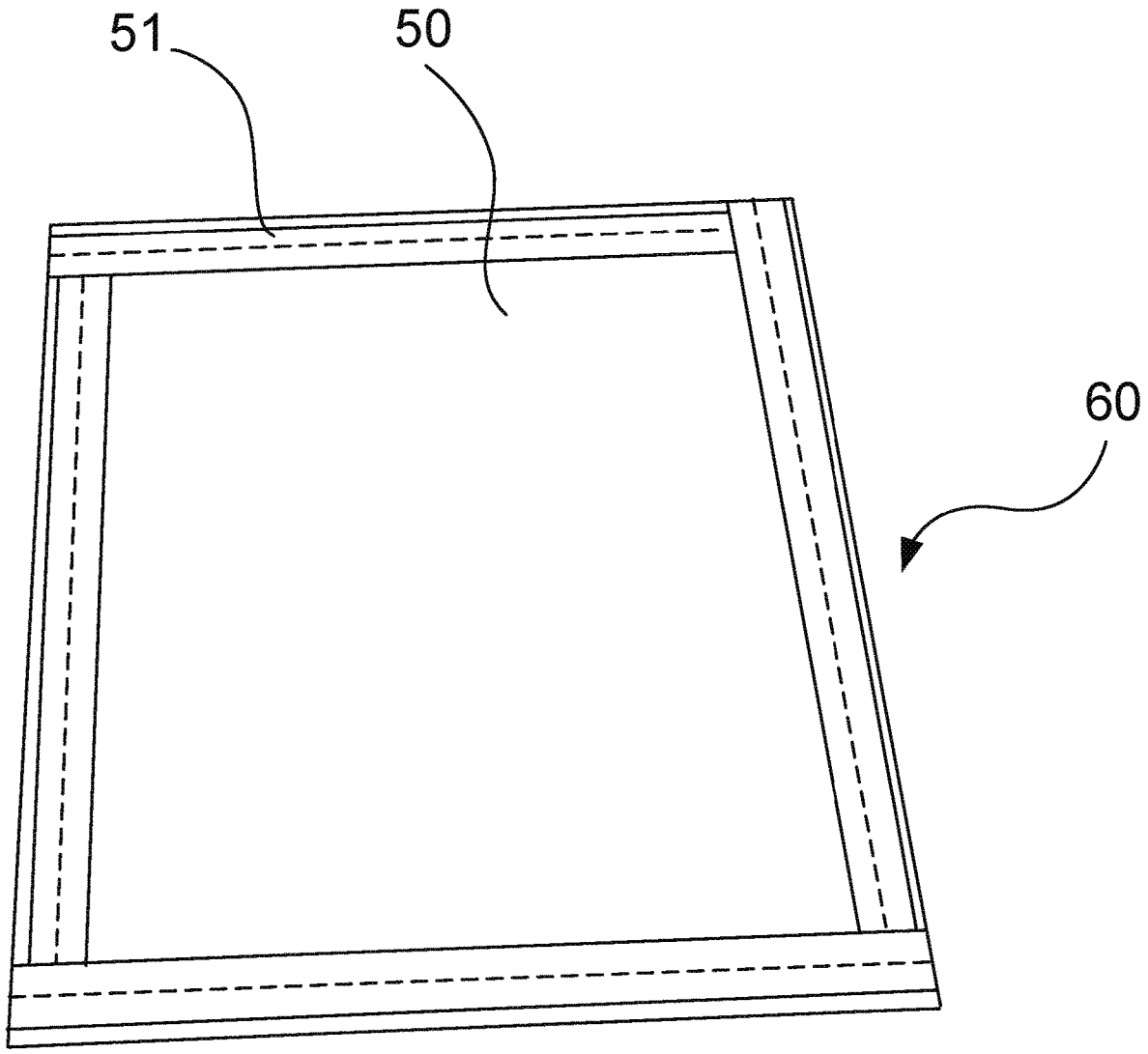
FIG. 12 is a perspective view of the protective roof tarp, in accordance with a non-limiting exemplary embodiment of the present disclosure.
Figure 13:
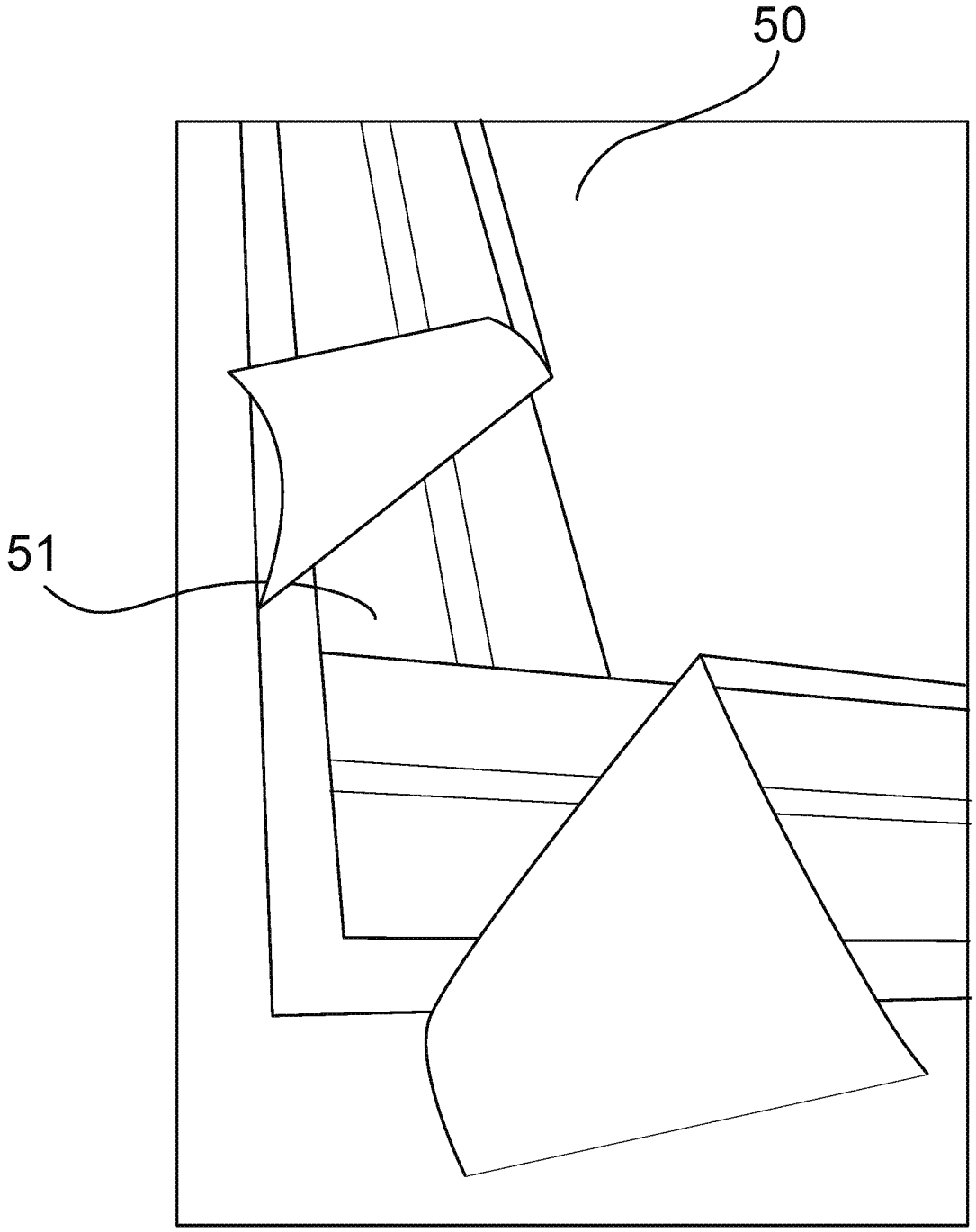
FIG. 13 is an enlarged partial perspective view of the bottom of the protective roof tarp, in accordance with a non-limiting exemplary embodiment of the present disclosure.
Figure 14:
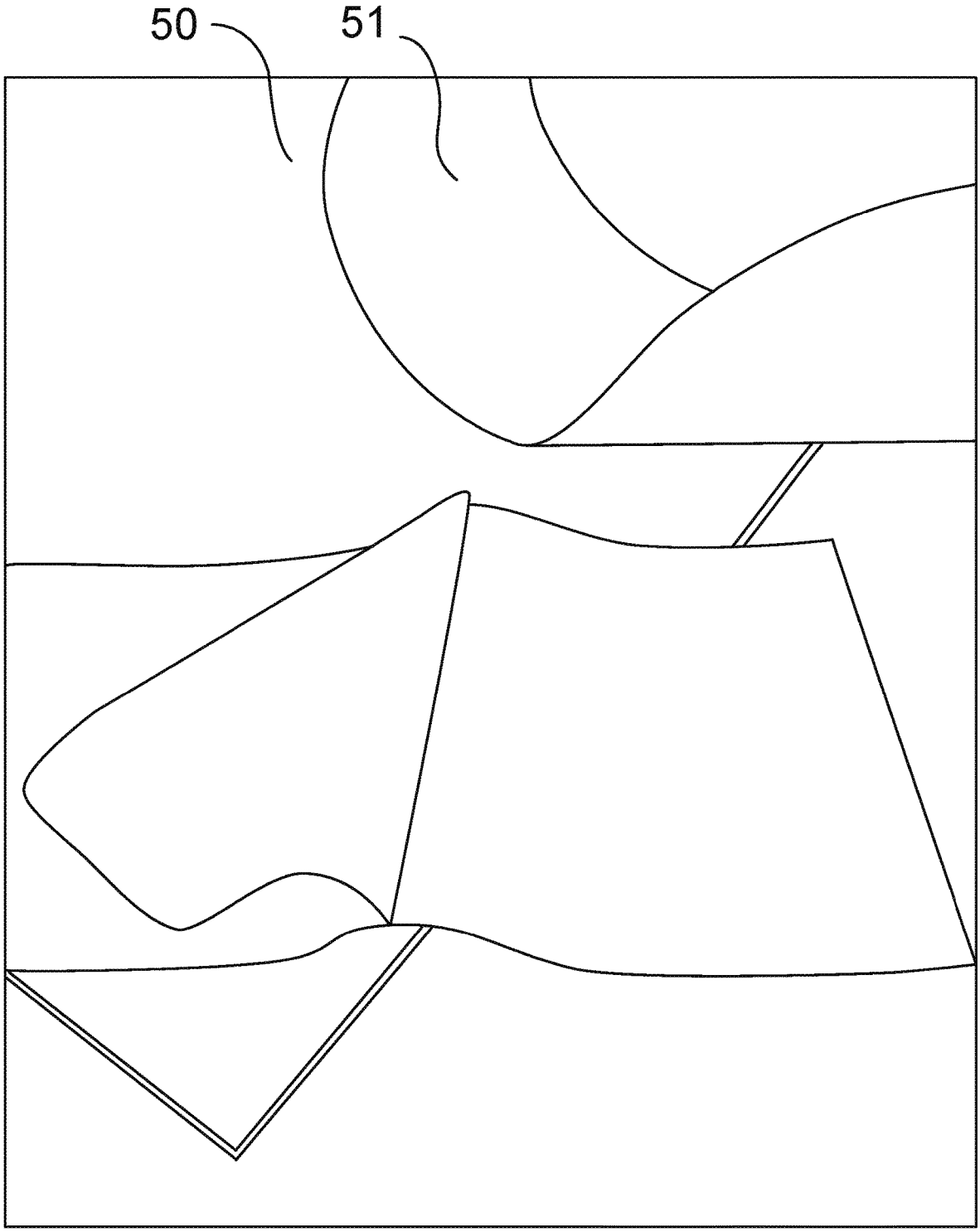
FIG. 14 is a perspective view of the adhesive tape, in accordance with a non-limiting exemplary embodiment of the present disclosure.
Figure 15:
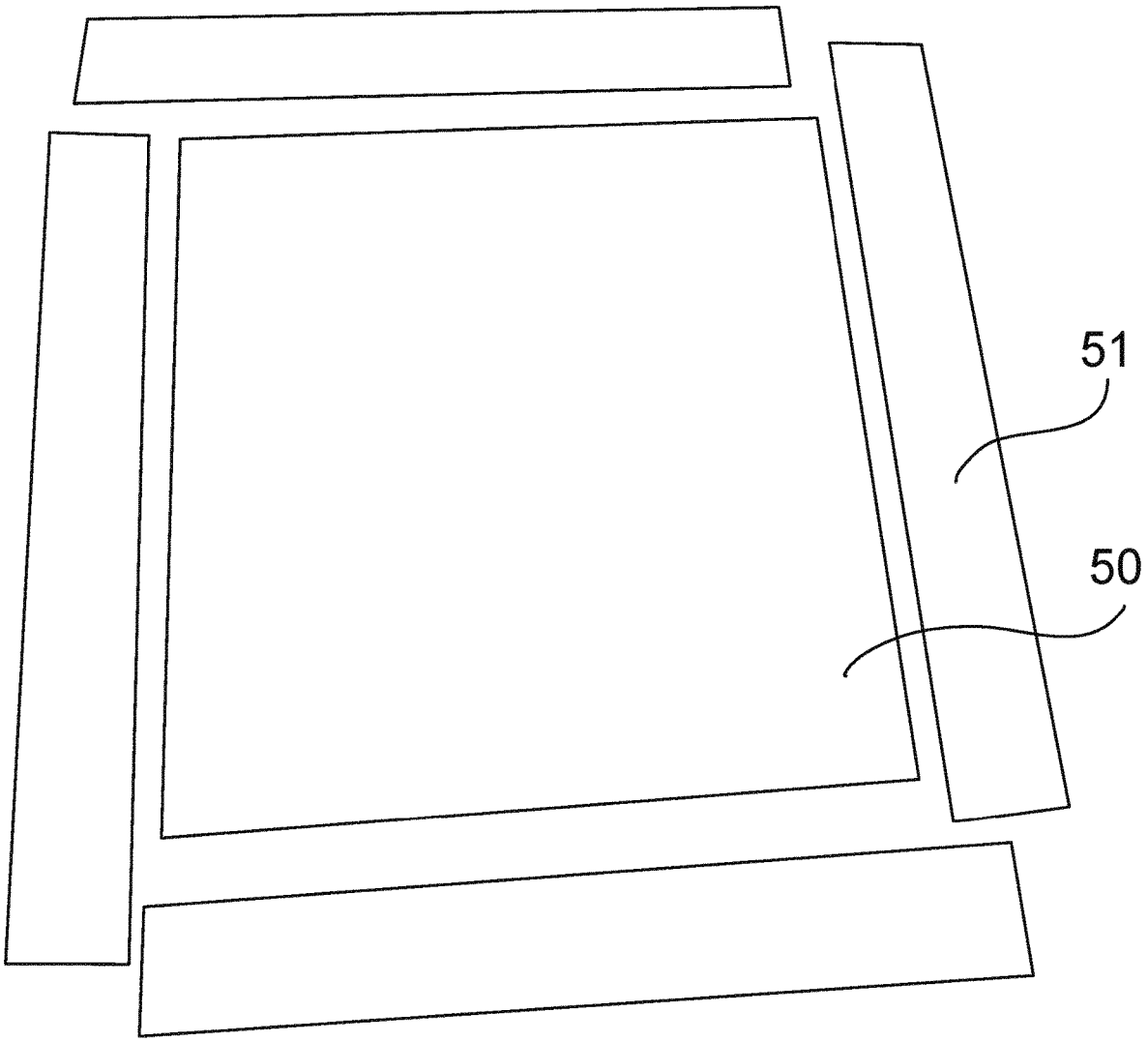
FIG. 15 is an exploded view of the protective roof tarp, in accordance with a non-limiting exemplary embodiment of the present disclosure.
Figure 16:
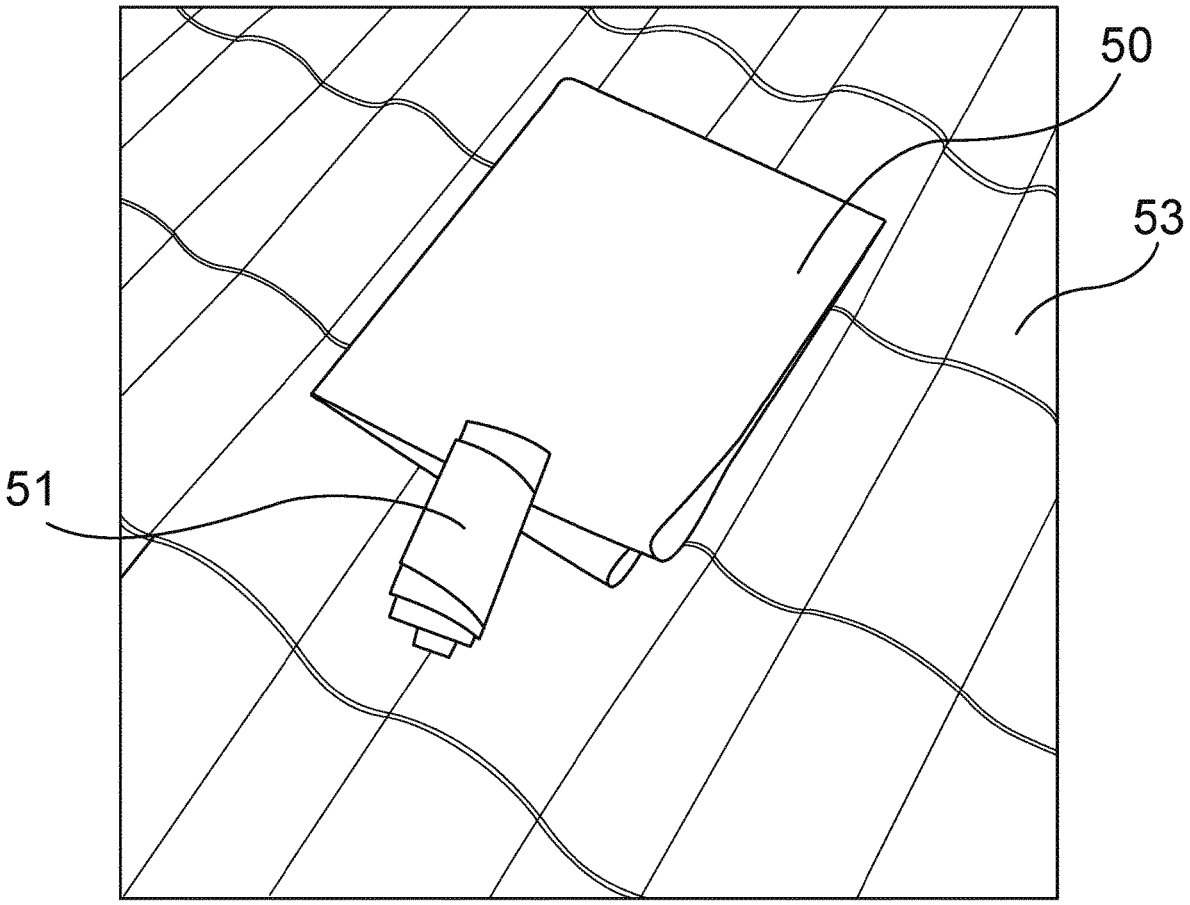
FIG. 16 is a perspective view of an unassembled protective roof tarp, in accordance with a non-limiting exemplary embodiment of the present disclosure.
Figure 17:
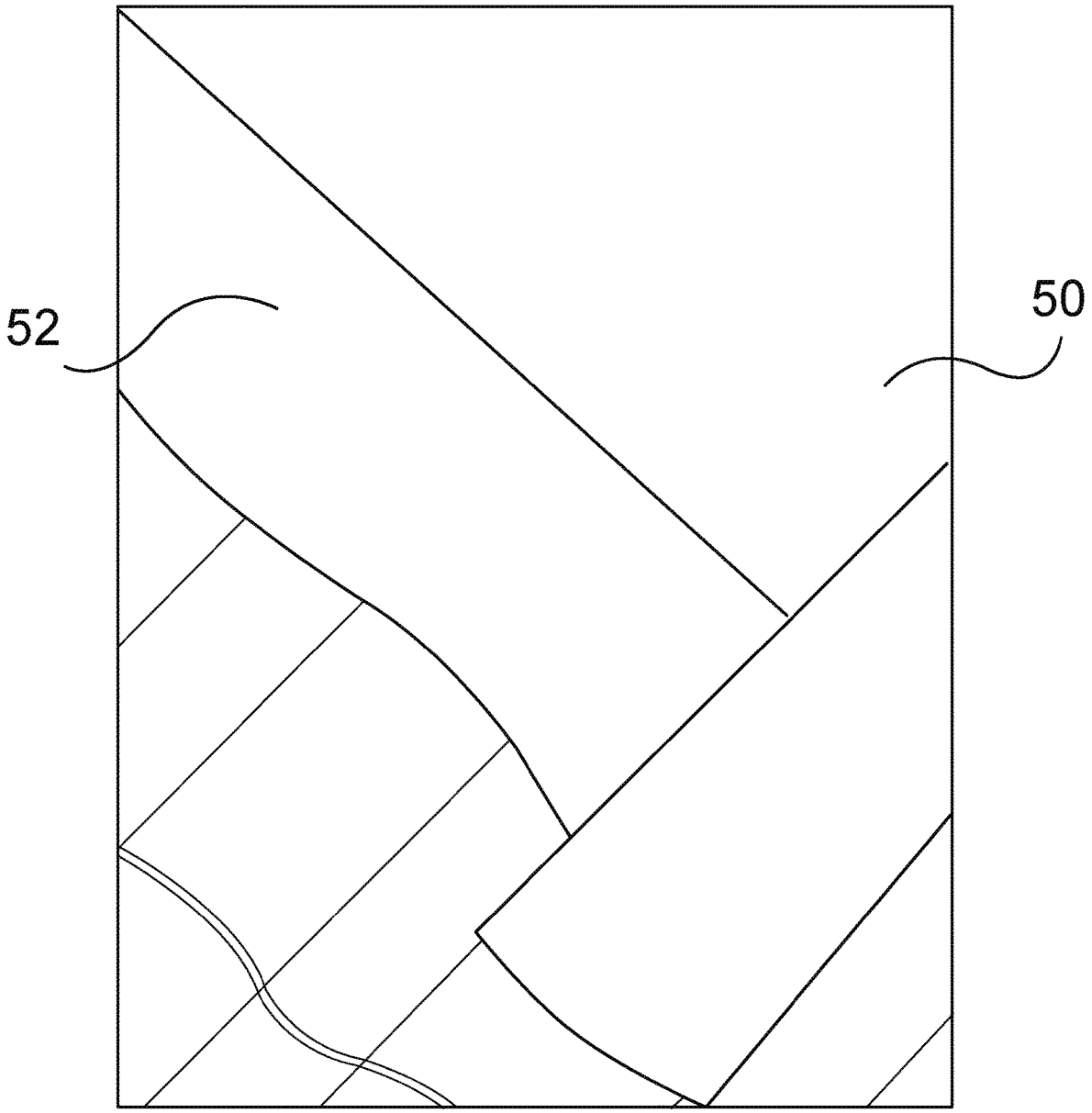
FIG. 17 is a perspective view of the protective roof tarp, in accordance with a non-limiting exemplary embodiment of the present disclosure.
Figure 18:
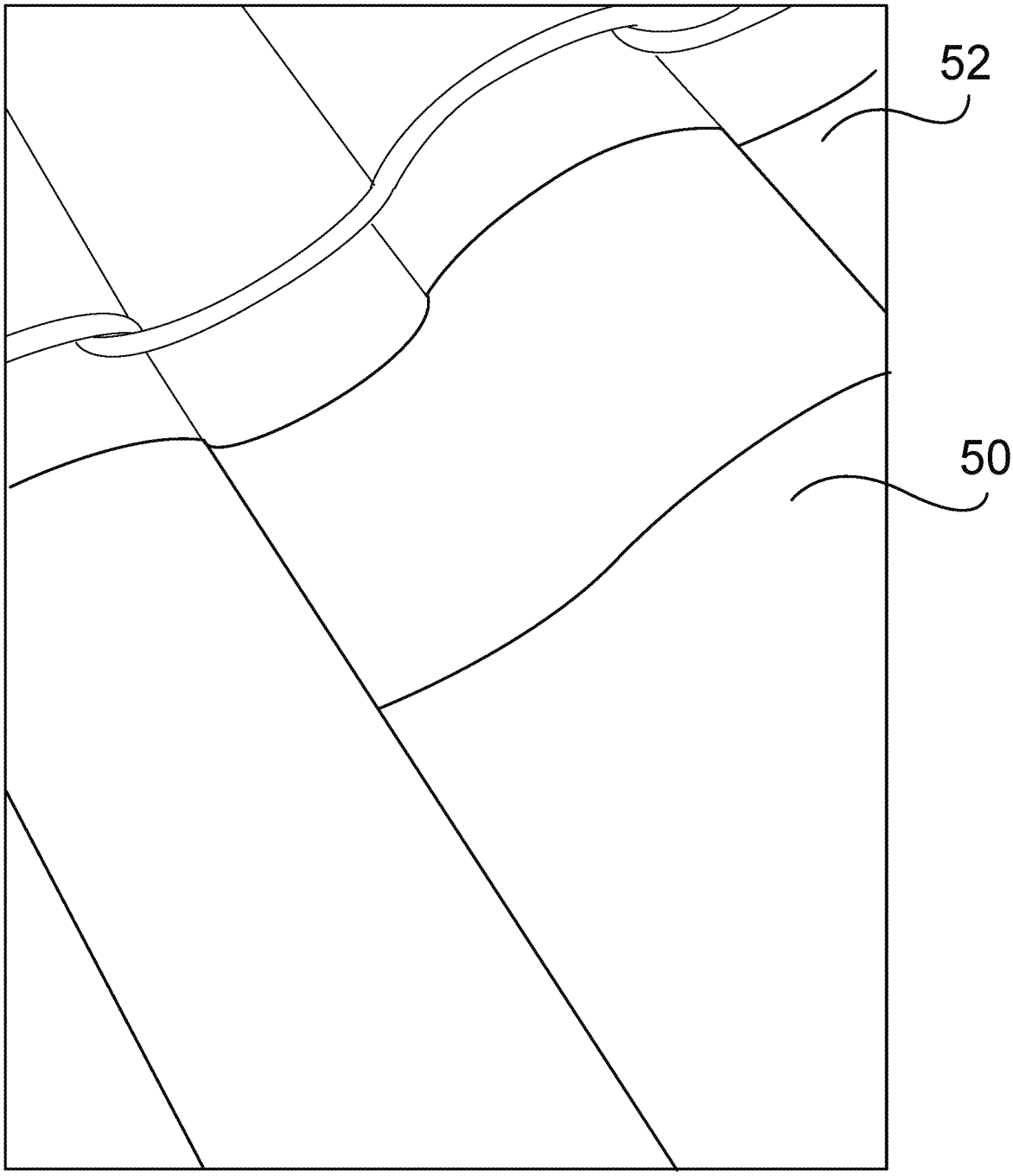
FIG. 18 is a perspective view of the protective roof tarp, in accordance with a non-limiting exemplary embodiment of the present disclosure.
Figure 19:
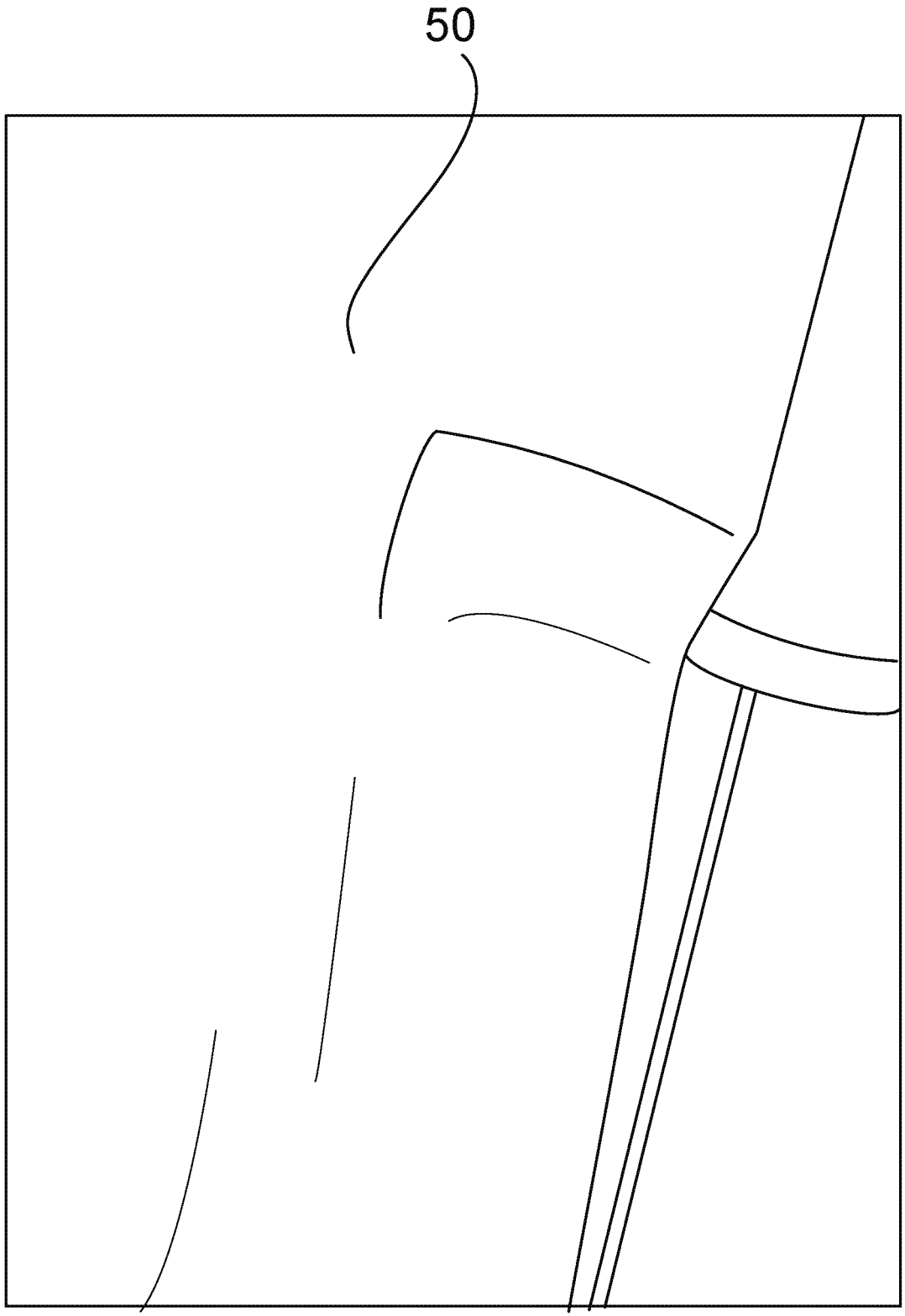
FIG. 19 is a perspective view of the protective roof tarp, in accordance with a non-limiting exemplary embodiment of the present disclosure.
Figure 20:
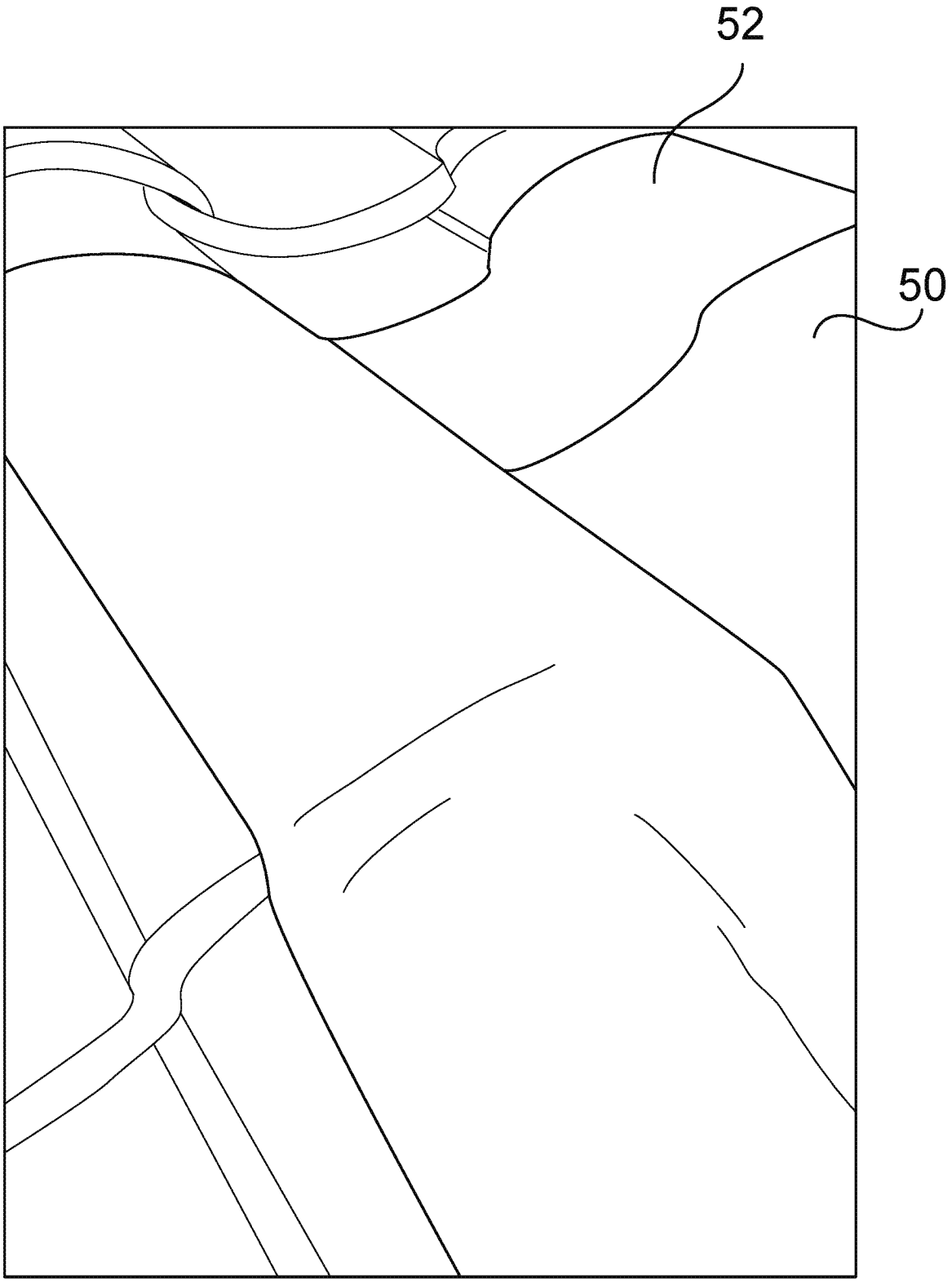
FIG. 20 is a perspective view of the protective roof tarp, in accordance with a non-limiting exemplary embodiment of the present disclosure.
Figure 21:
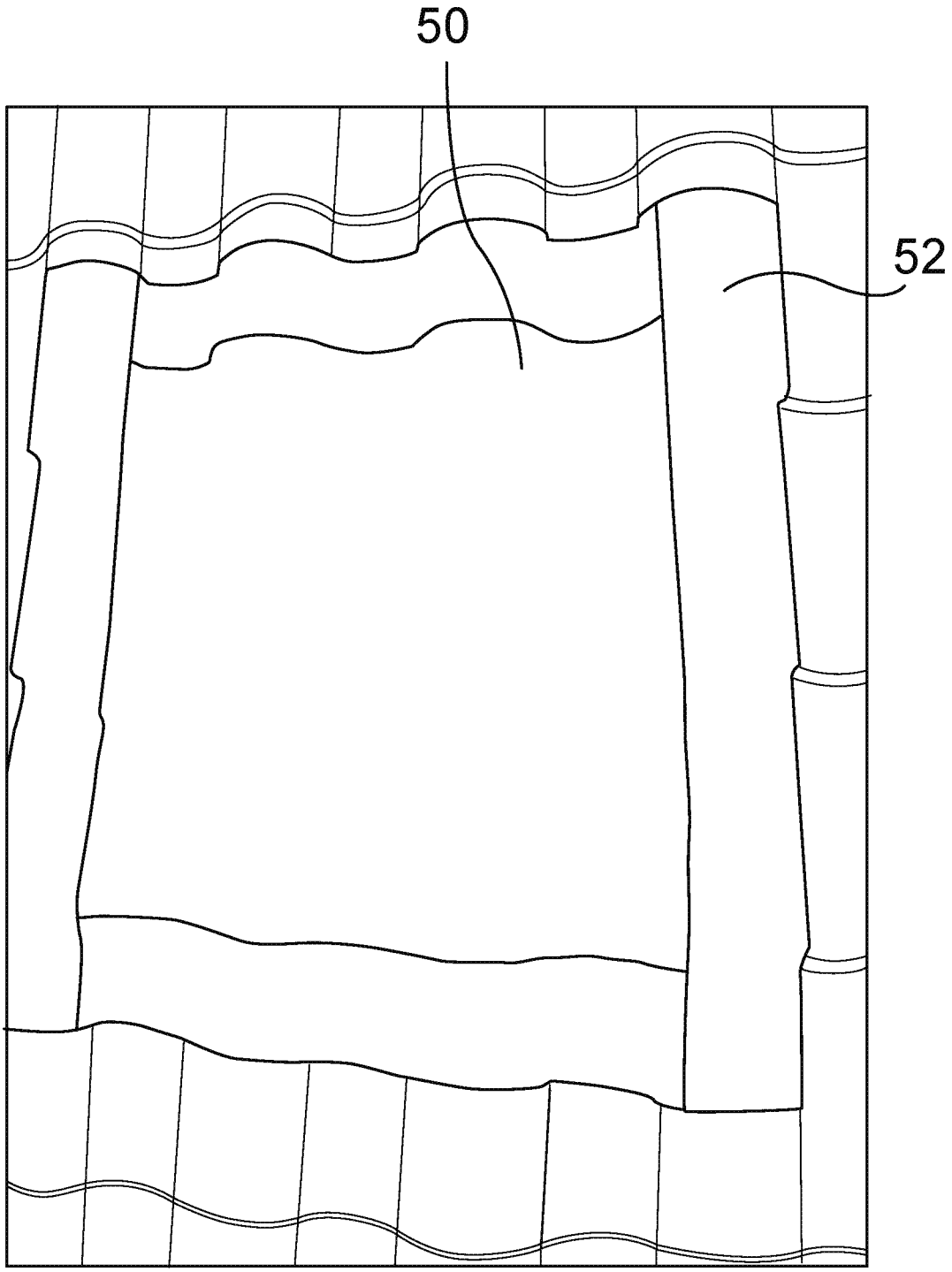
FIG. 21 is a perspective view of the protective roof tarp, in accordance with a non-limiting exemplary embodiment of the present disclosure.
Figure 22:
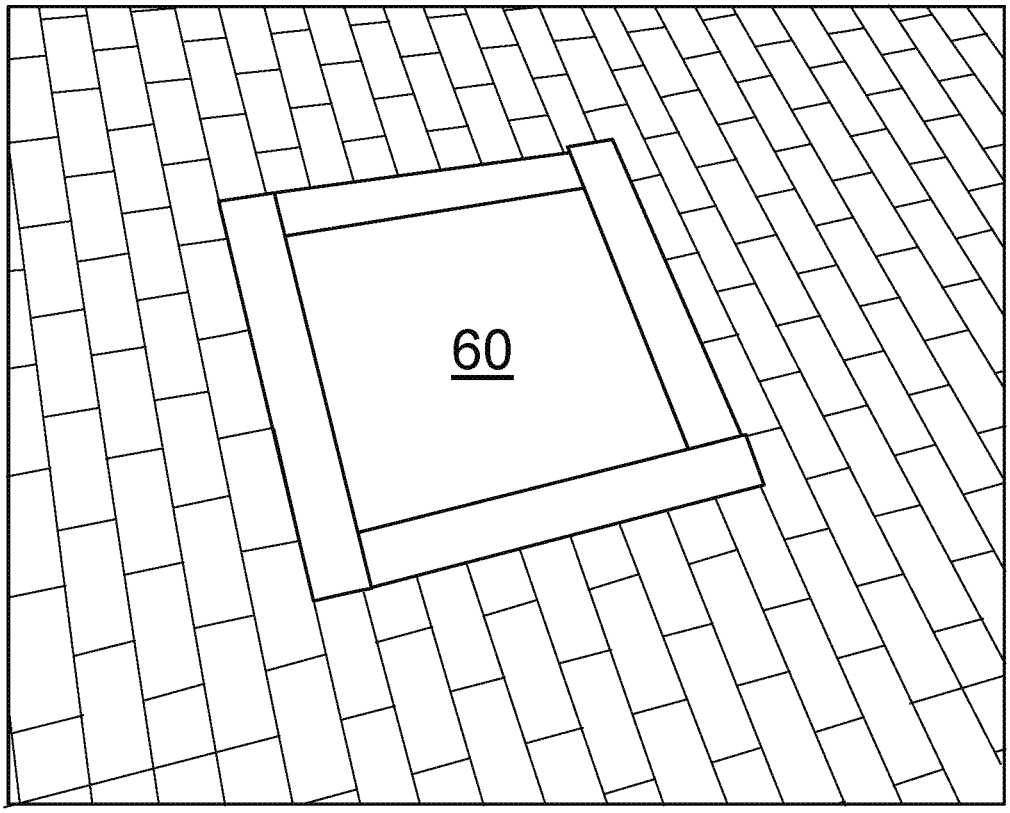
FIG. 22 is a perspective view of the protective roof tarp, in accordance with a non-limiting exemplary embodiment of the present disclosure.
Figure 23:
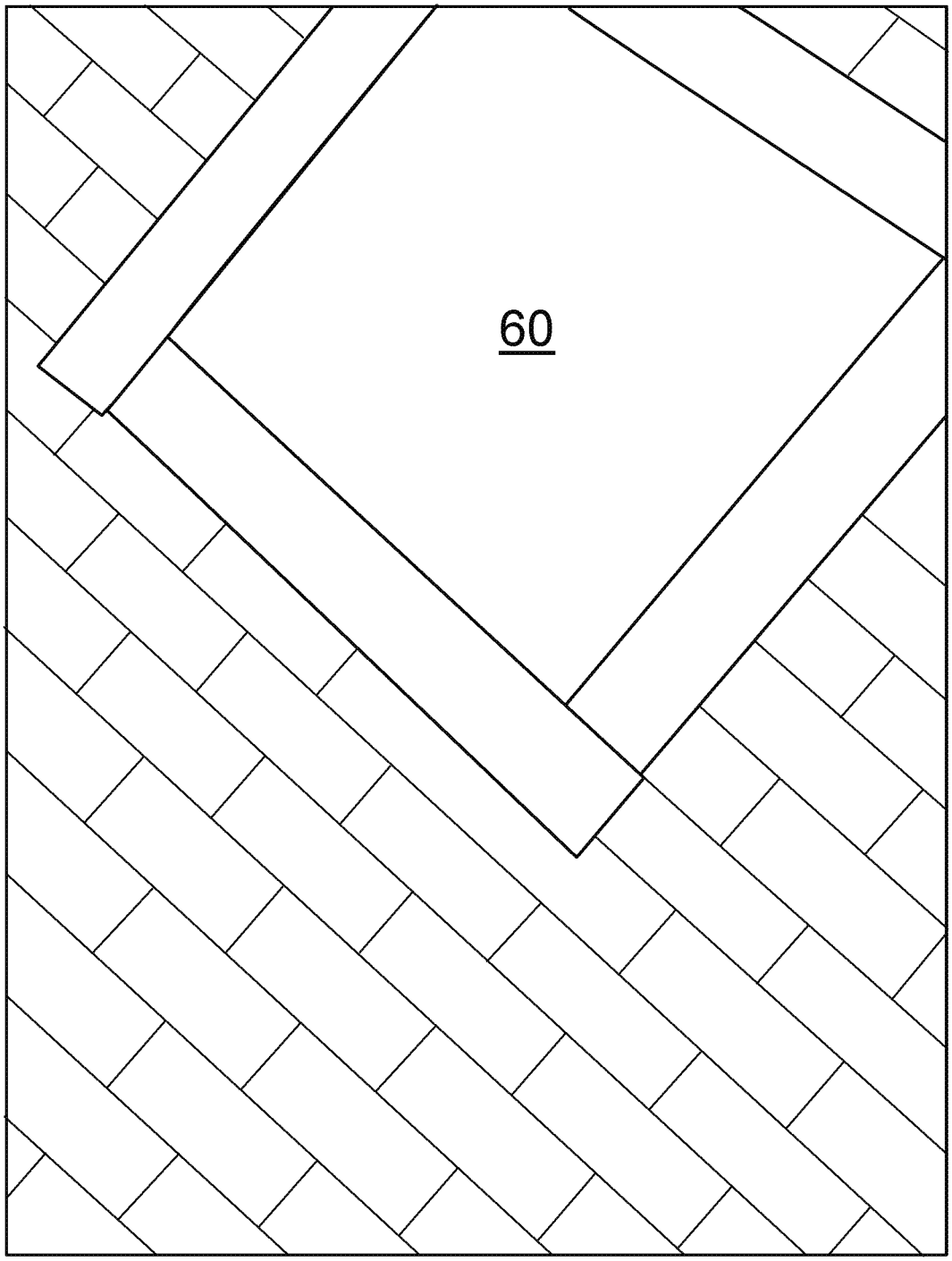
FIG. 23 is a perspective view of the protective roof tarp, in accordance with a non-limiting exemplary embodiment of the present disclosure.
Figure 24:
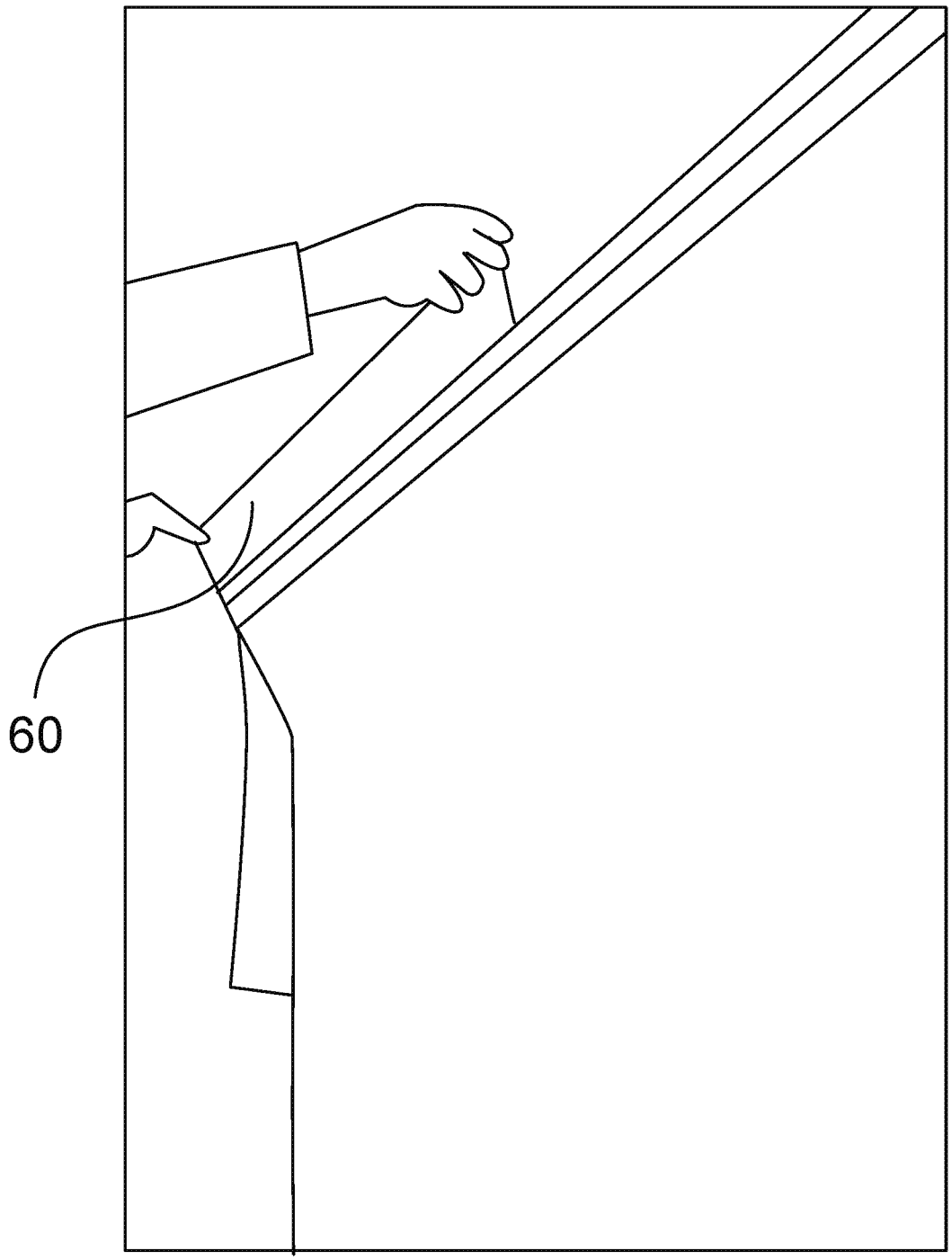
FIG. 24 is a perspective view showing application of an adhesive tape to an edge of a building, in accordance with a non-limiting exemplary embodiment of the present disclosure.
Figure 25:
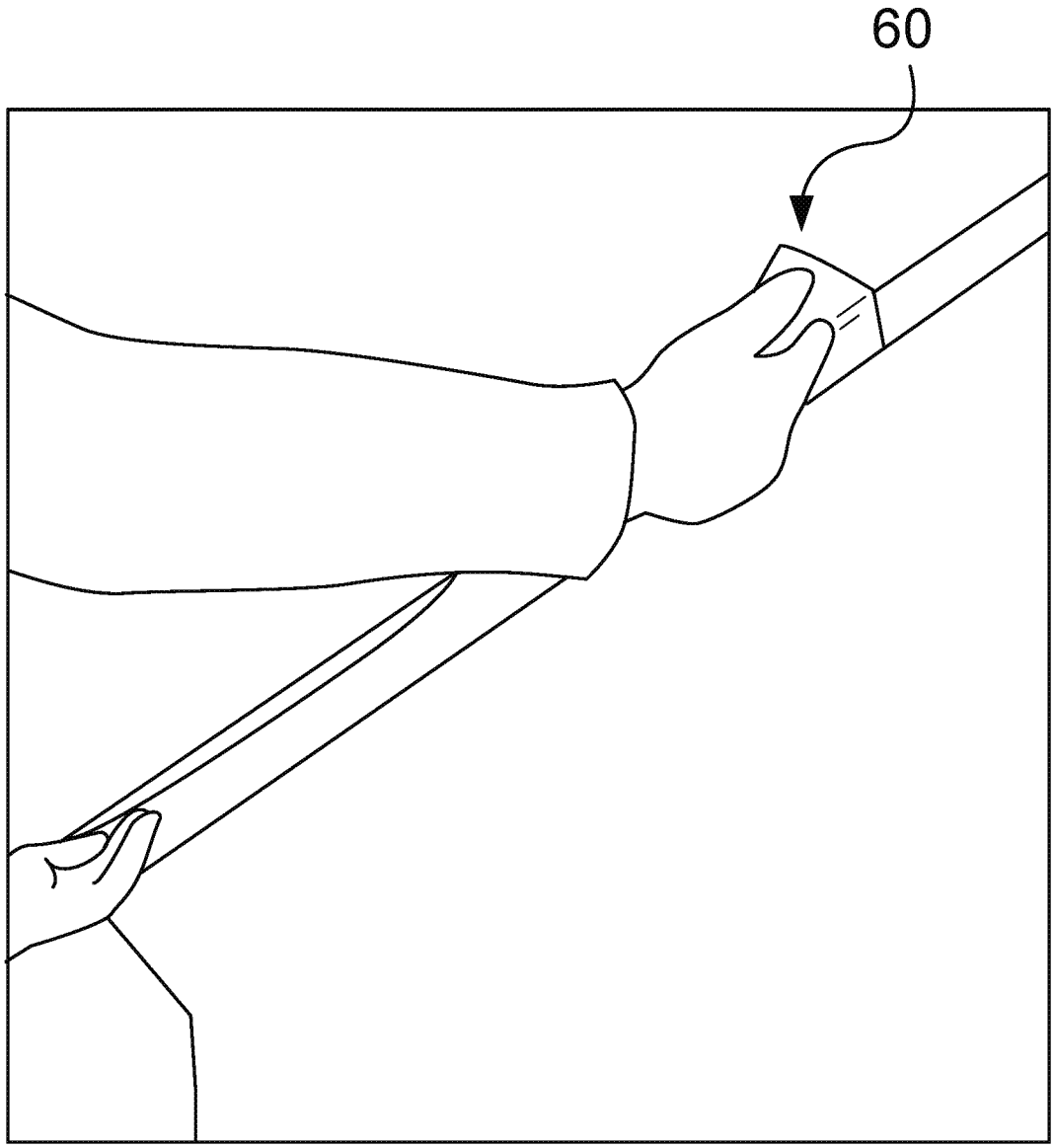
FIG. 25 is a perspective view showing application of an adhesive tape to an edge of a building, in accordance with a non-limiting exemplary embodiment of the present disclosure.
Figure 26:
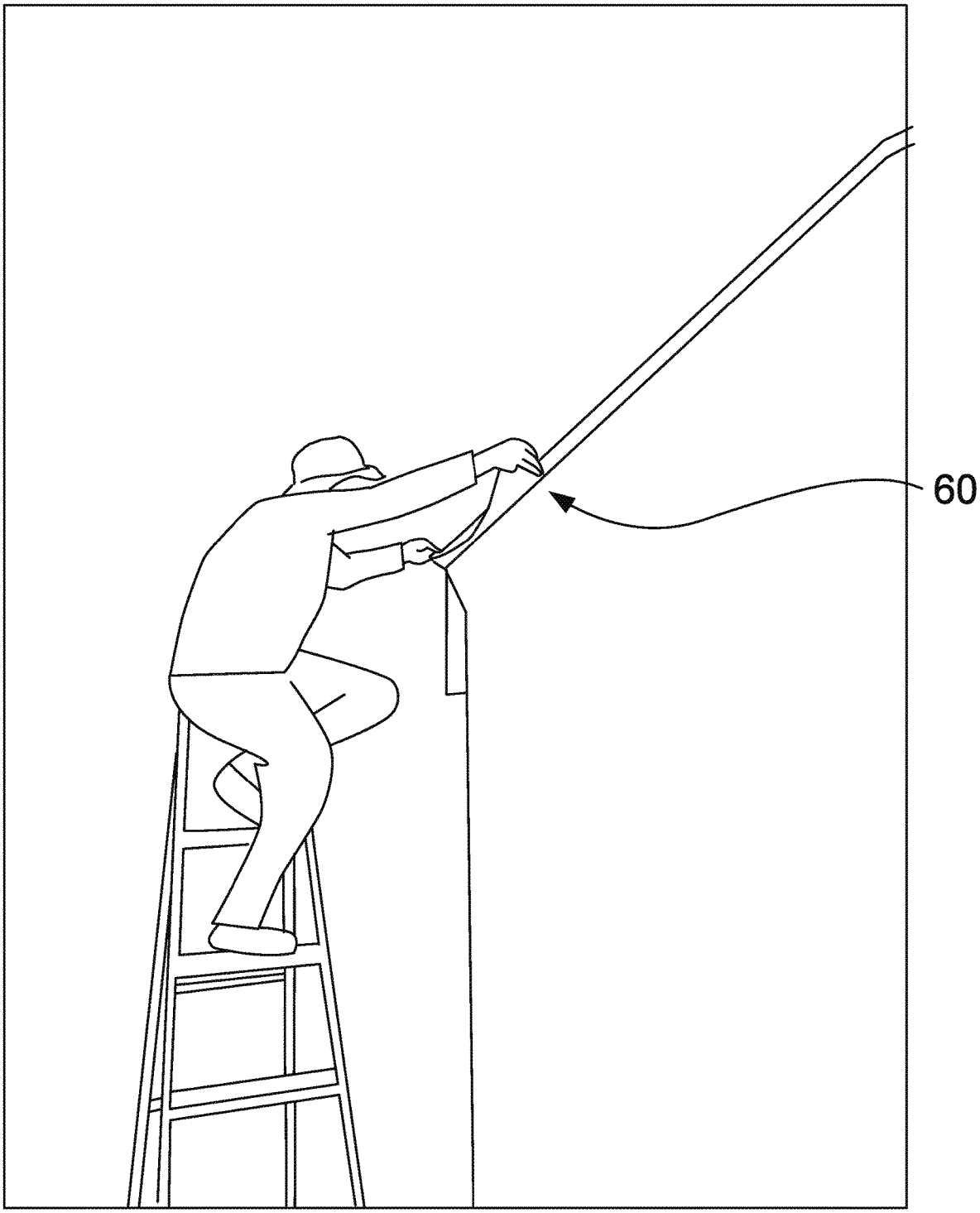
FIG. 26 is a perspective view showing application of an adhesive tape to an edge of a building, in accordance with a non-limiting exemplary embodiment of the present disclosure.
Figure 27:
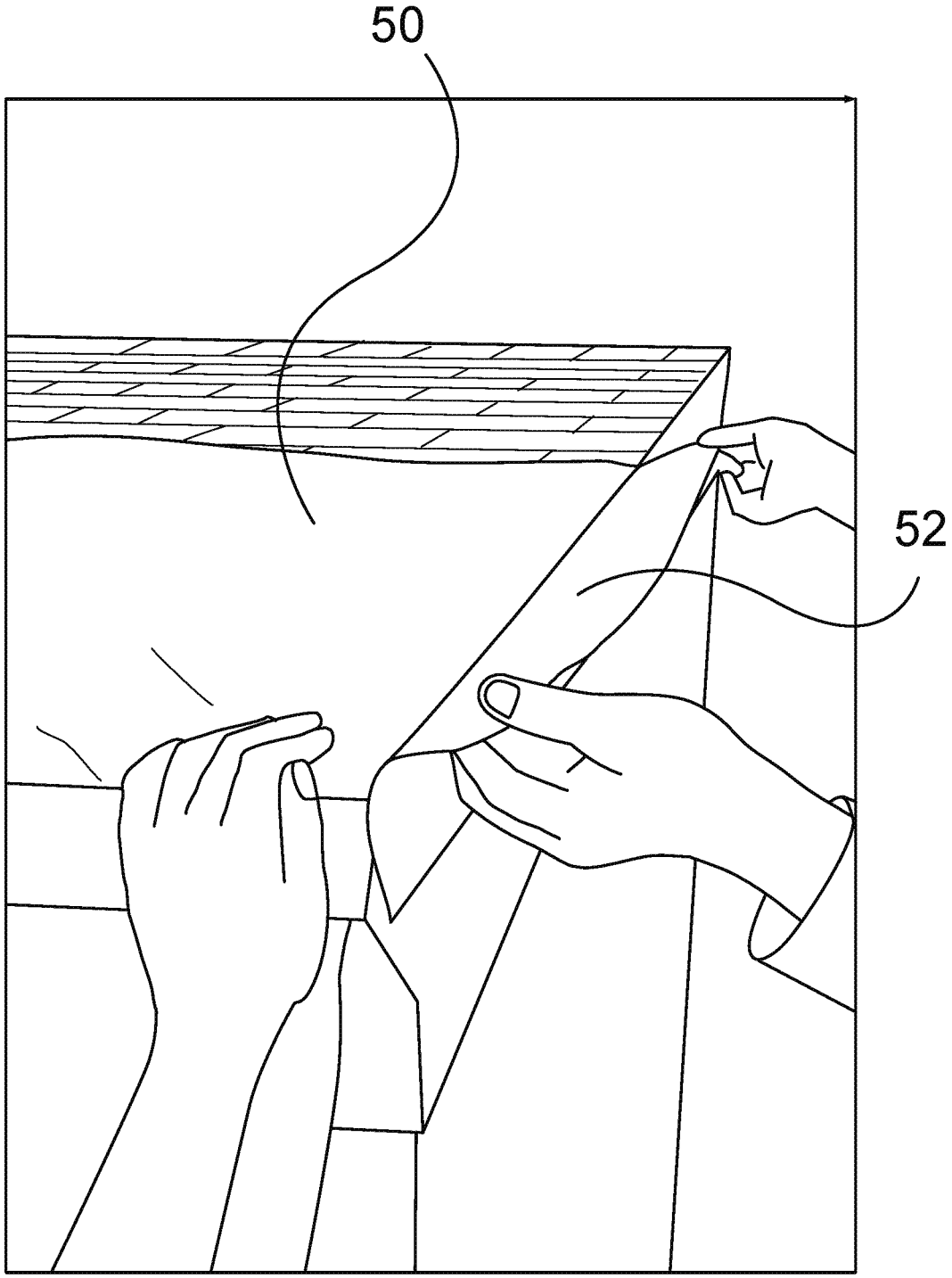
FIG. 27 is a perspective view showing application of an adhesive tape to an edge of a building, in accordance with a non-limiting exemplary embodiment of the present disclosure.
Figure 28:
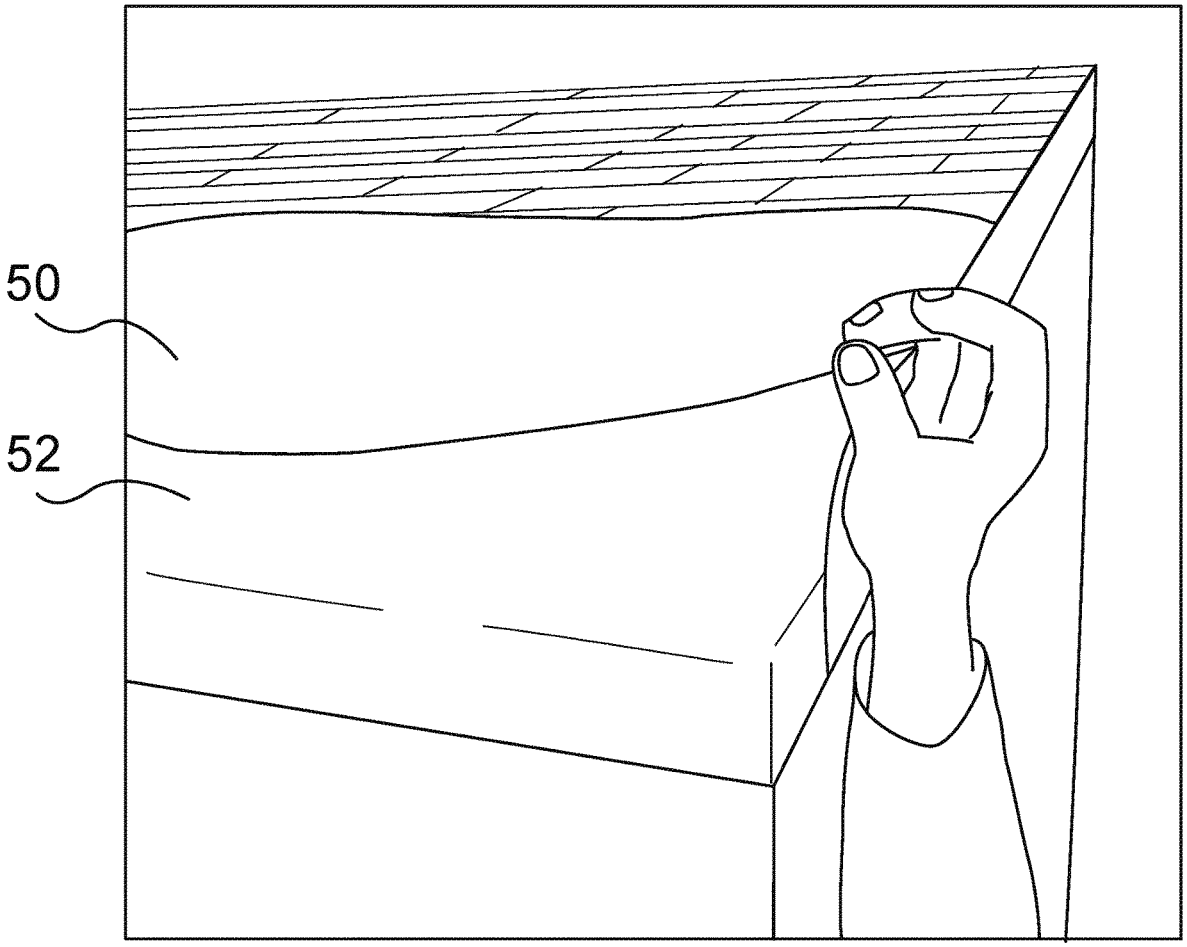
FIG. 28 is a perspective view showing application of an adhesive tape to an edge of a building, in accordance with a non-limiting exemplary embodiment of the present disclosure.
Figure 29:
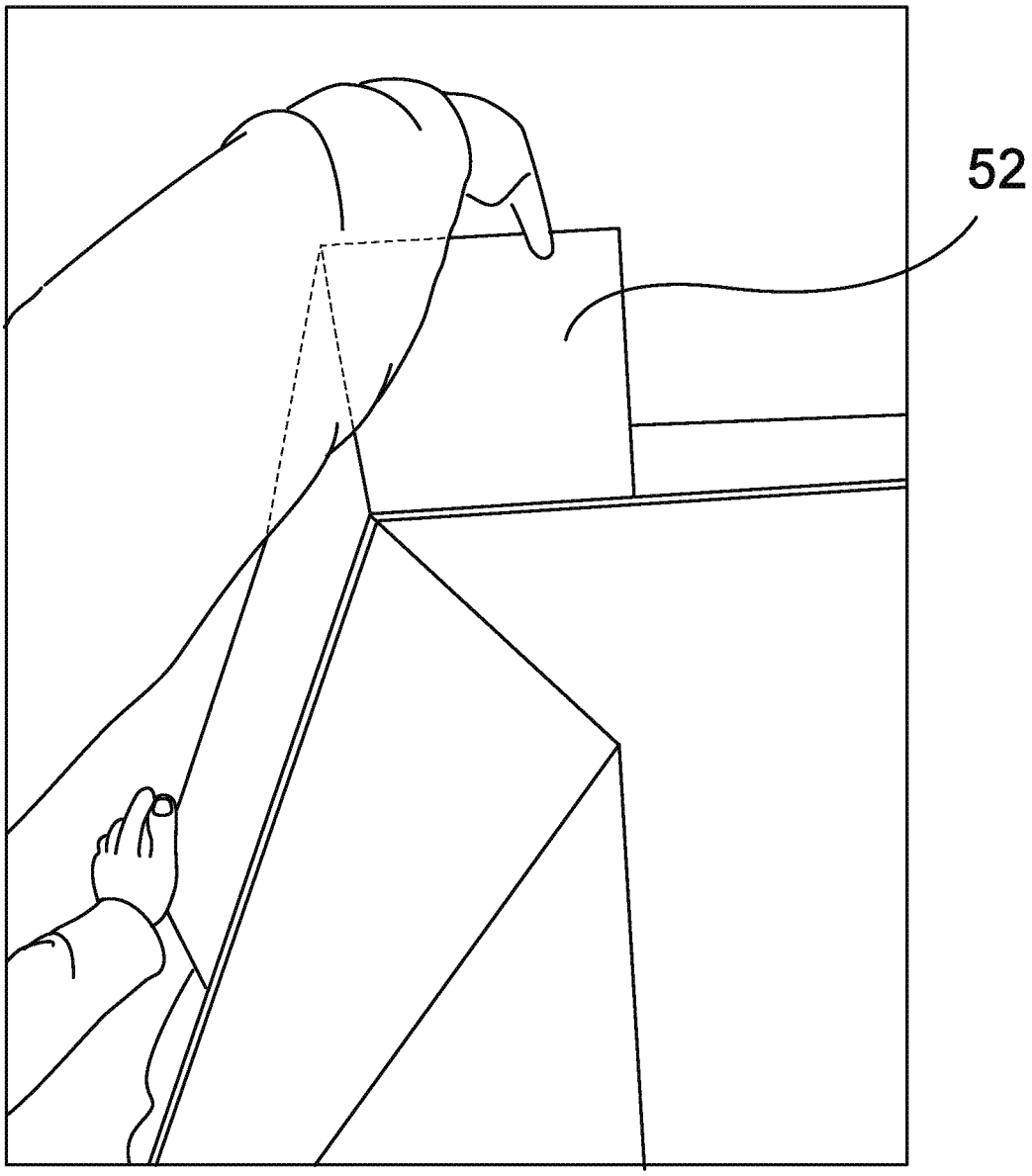
FIG. 29 is a perspective view showing application of an adhesive tape to an edge of a building, in accordance with a non-limiting exemplary embodiment of the present disclosure.
Figure 30:
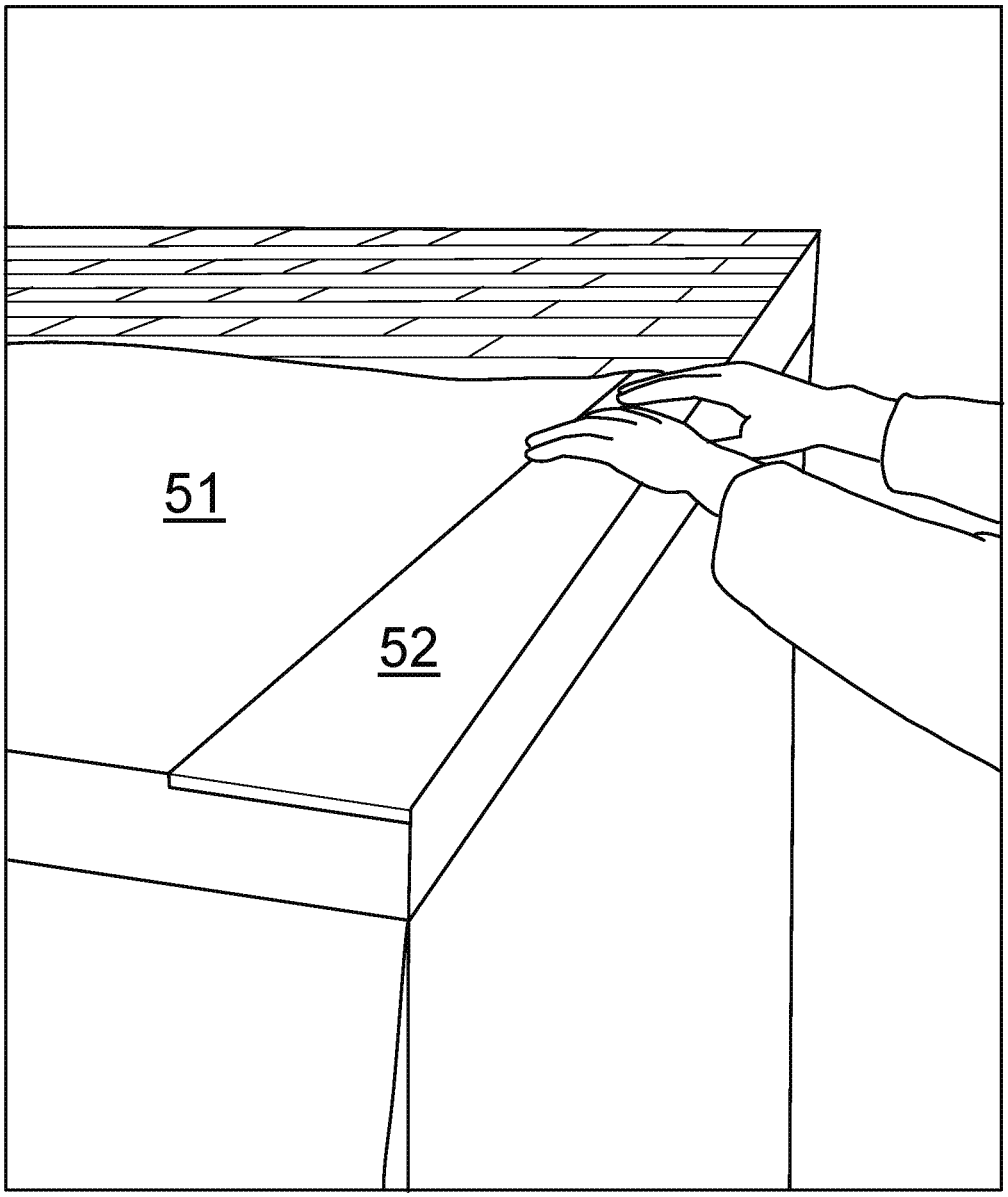
FIG. 30 is a perspective view showing application of an adhesive tape to an edge of a building, in accordance with a non-limiting exemplary embodiment of the present disclosure.
Figure 31:
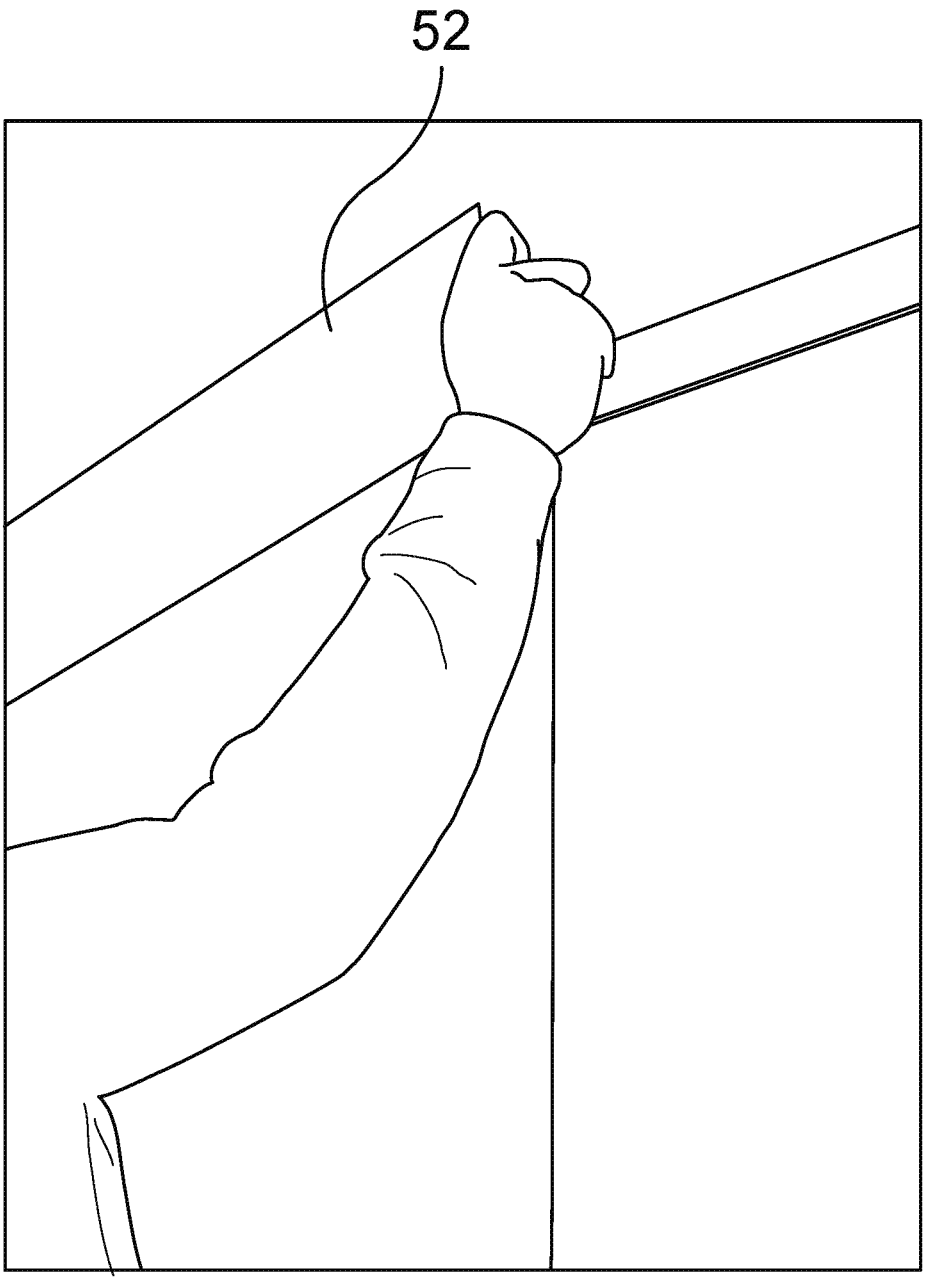
FIG. 31 is a perspective view showing application of an adhesive tape to an edge of a building, in accordance with a non-limiting exemplary embodiment of the present disclosure.
Figure 32:
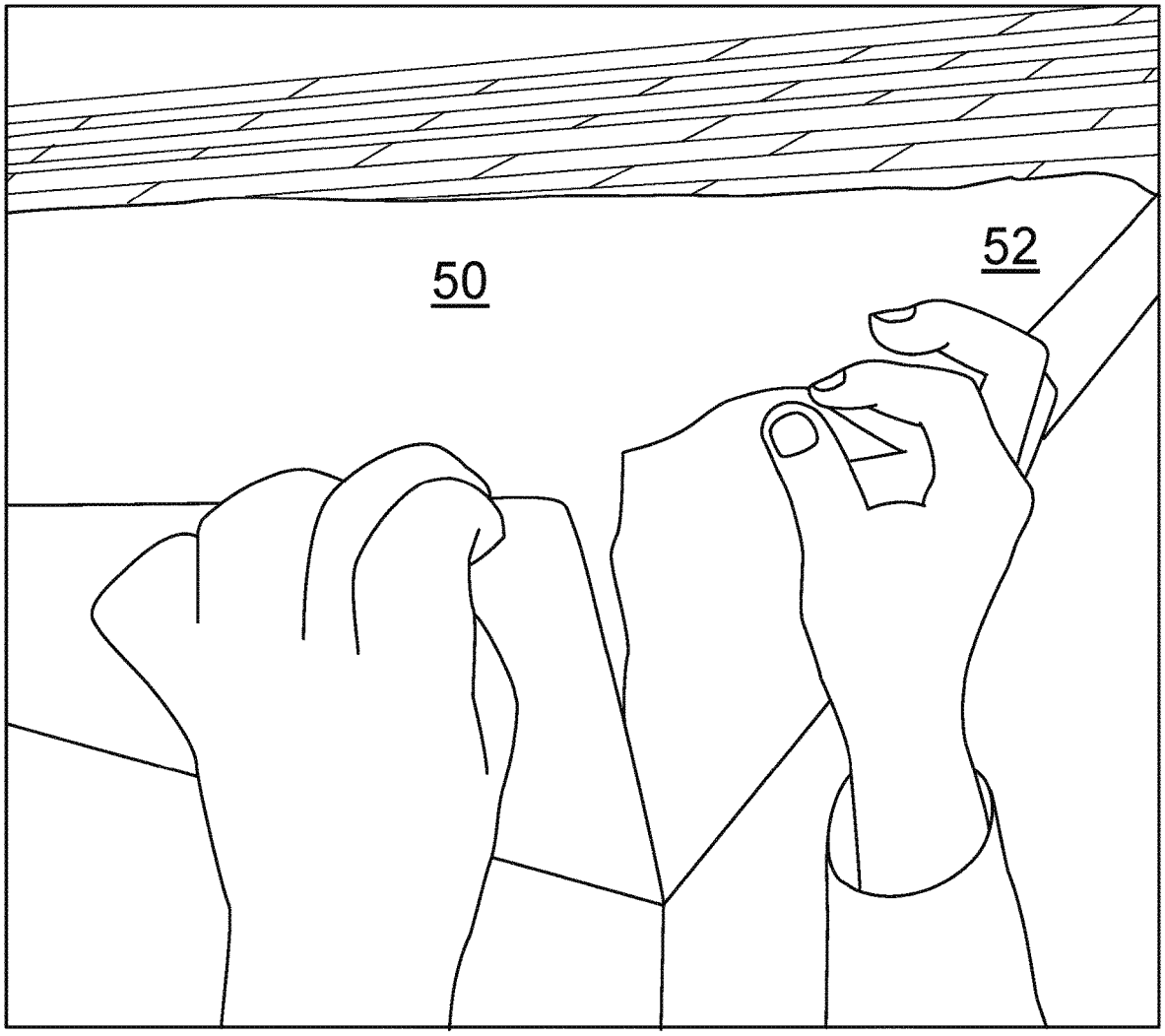
FIG. 32 is a perspective view showing application of an adhesive tape to an edge of a building, in accordance with a non-limiting exemplary embodiment of the present disclosure.
Figure 33:
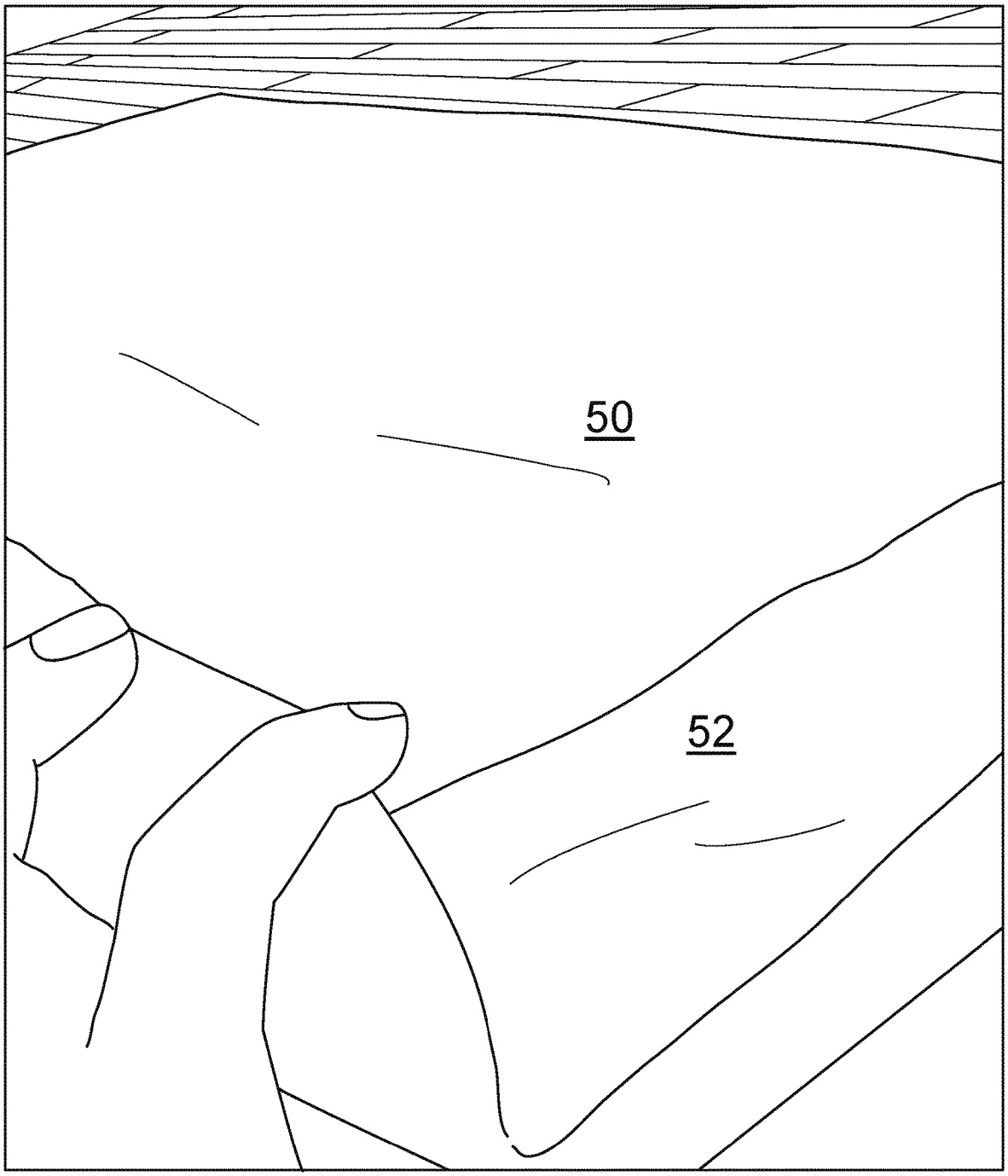
FIG. 33 is a perspective view showing application of an adhesive tape to an edge of a building, in accordance with a non-limiting exemplary embodiment of the present disclosure.
Figure 34:
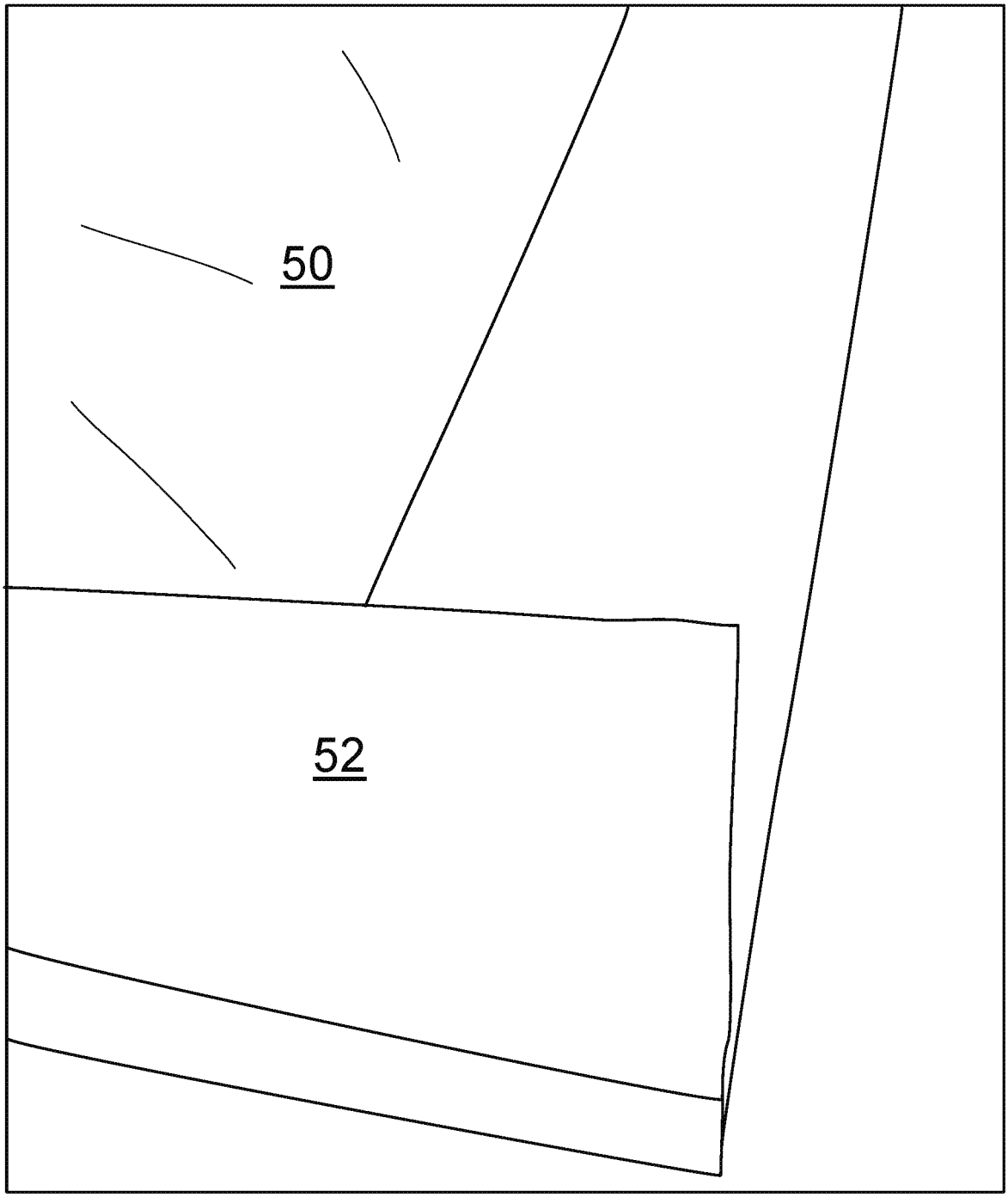
FIG. 34 is a perspective view showing application of an adhesive tape to an edge of a building, in accordance with a non-limiting exemplary embodiment of the present disclosure.
Figure 35:
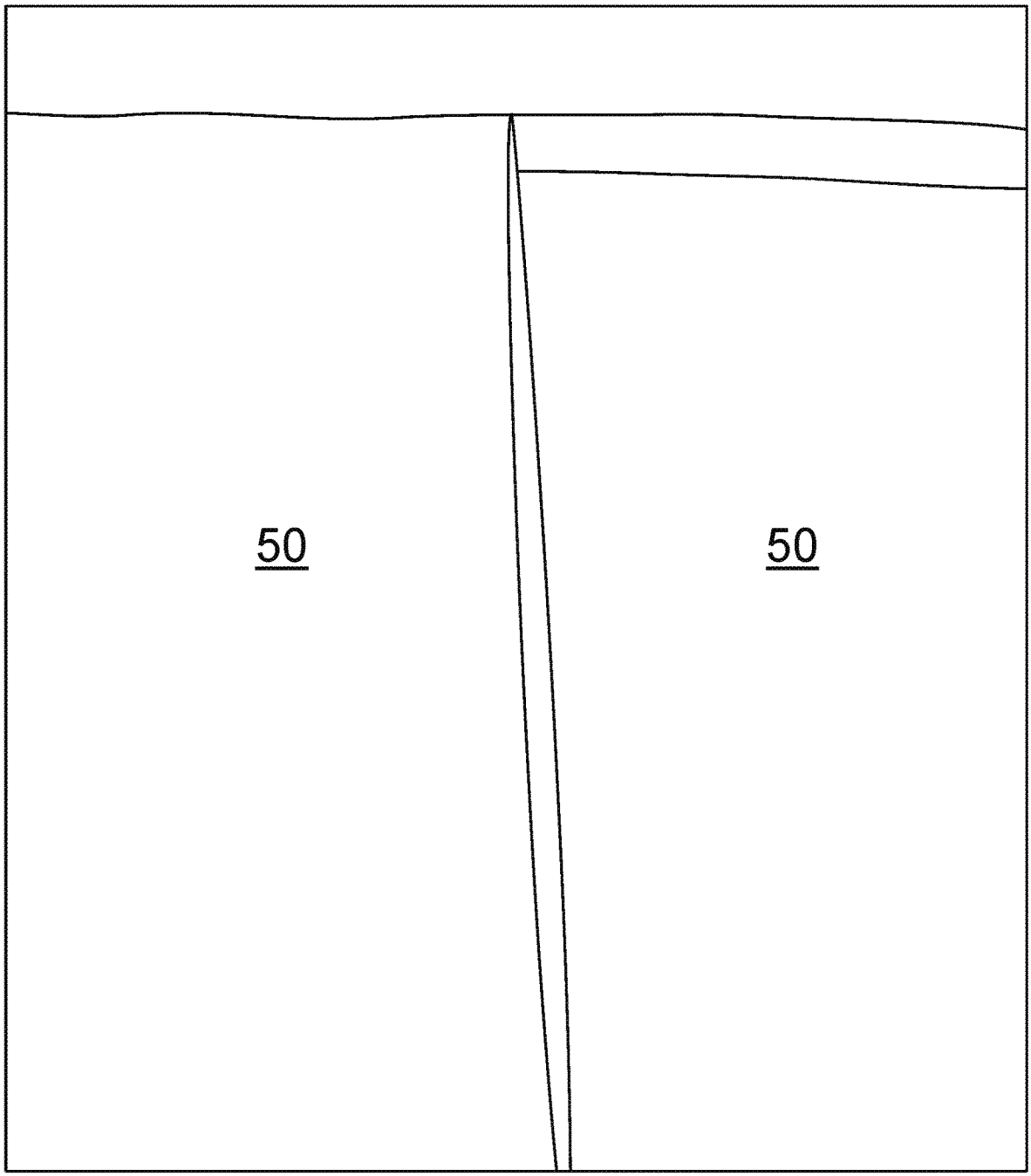
FIG. 35 is bottom perspective view of two bodies conjoined together, in accordance with a non-limiting exemplary embodiment of the present disclosure.
Figure 36:
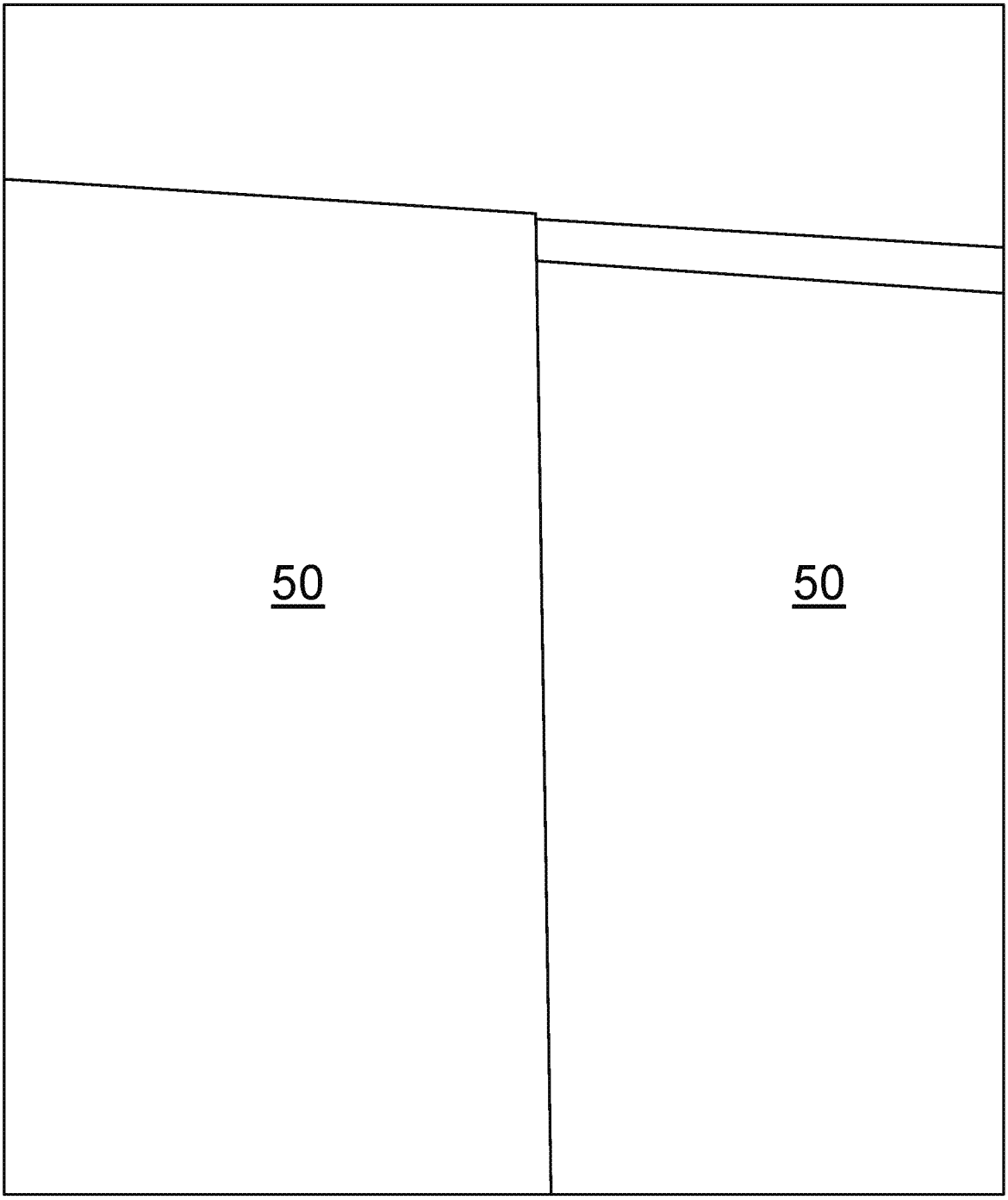
FIG. 36 is a top perspective view of two bodies conjoined together, in accordance with a non-limiting exemplary embodiment of the present disclosure.
Figure 37:
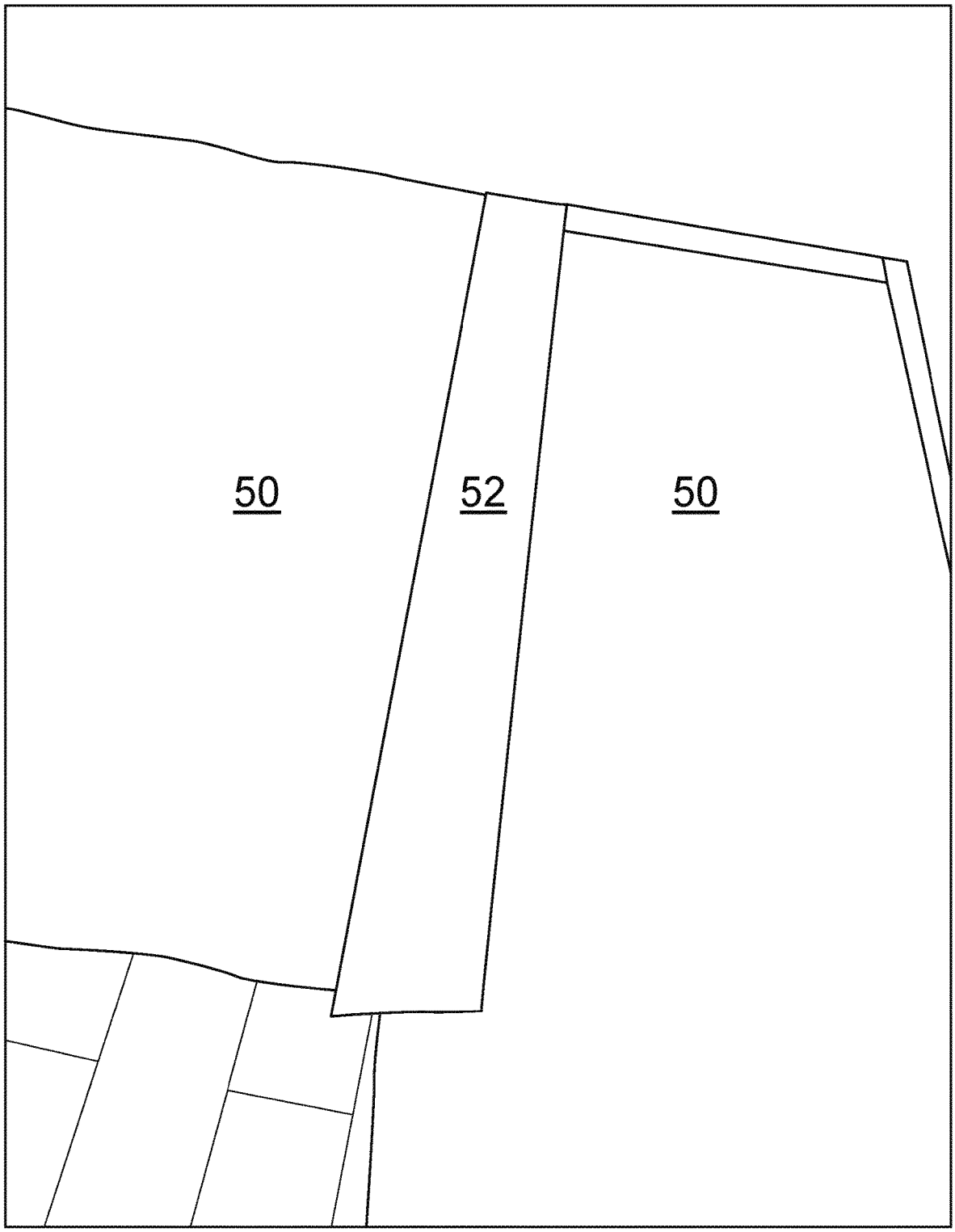
FIG. 37 is a top perspective view of two bodies conjoined together with an adhesive layer attached thereto, in accordance with a non-limiting exemplary embodiment of the present disclosure.
Figure 38:
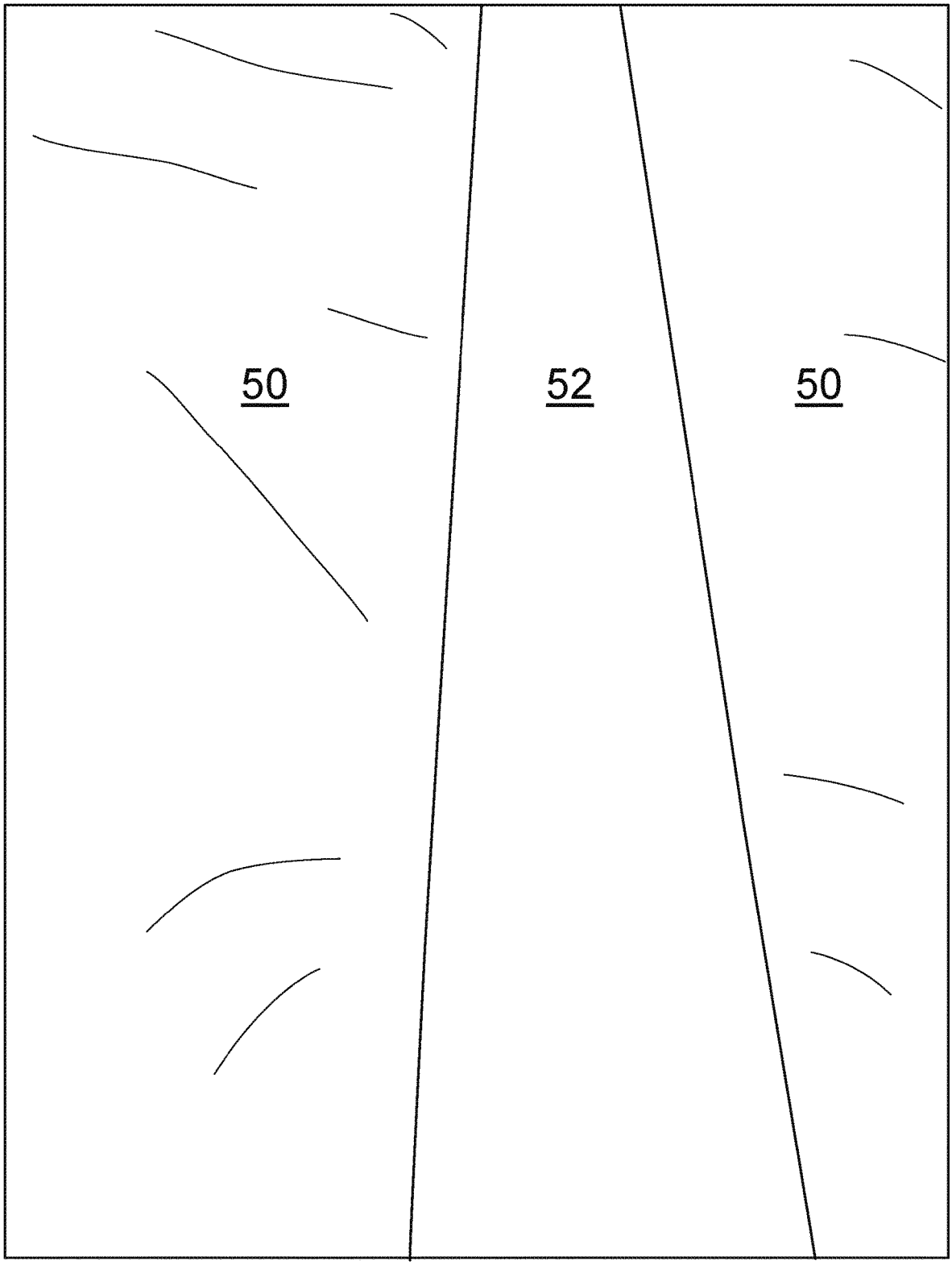
FIG. 38 is an enlarged perspective view of FIG. 37, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means ±15% of the numerical.

If used herein, "substantially" means largely if not wholly that which is specified but so close that the difference is insignificant.

The term "roof tile" includes a variety of roof surfaces including, but not limited to, Thermoplastic Polyolefin (TPO—blend of polypropylene and ethylene-propylene rubber), Ethylene Propylene Diene Monomer (EPDM), metal panels, clay tiles, cement tiles, asphalt shingles, flat membranes (e.g., base sheet, cap sheet, etc.), wood, fiberglass, plastic, block, brick, smooth BUR, smooth SBS, smooth APP, Hypalon and PVC.

The non-limiting exemplary embodiment(s) is/are referred to generally in FIGS. 1-46 and is/are intended to provide a protective roof tarp 60 that yields the new, useful, and unexpected results of a heat-shrinkable impermeable body 50 having superior adhesion to various roof contours including around vent pipe boots for a better repair. The protective roof tarp 60 employs deformably pliable adhesive tape(s) 51, 52 configured to maintain continuous adhesion (e.g. surface area contact) to both barrel-shaped roof tile 53 as well as planar-shaped roof tile 53 having granules 54 attached to a top surface thereof such that adhesive material penetrates past the granules 54 and engages a roof tile 53 substrate therebeneath for effectively prohibiting water from flowing beneath the protective tarp 60, and onto the roof file, during extended periods of time and in inclement weather conditions. It should be understood that the exemplary embodiment(s) may be used with a variety of roof tile 53 shapes, and should not be limited to any particular roof tile 53 shape described herein.

The terms "tarp 60, " "membrane," and "body 50" are interchangeably used throughout the present disclosure. All terms include water impermeable and/or heat-shrinkable surfaces.

Referring to FIGS. 1-46 in general, in a non-limiting exemplary embodiment(s), the protective roof tarp 60, is illustrated, employs deformably pliable adhesive tape(s) 51, 52 configured to maintain continuous adhesion (e.g. surface area contact) to both barrel-shaped roof tile 53 as well as planar-shaped roof tile 53 having granules 54 attached to a top surface thereof such that adhesive material penetrates past the granules 54 and engages a roof tile 53 substrate therebeneath for effectively prohibiting water from flowing beneath the protective tarp 60, and onto the roof file, during extended periods of time and in inclement weather conditions. The roof tarp 60 eliminates the need of using nails, sandbags, and wood strips on a damaged roof. This makes the roof tarp 60 user-friendly to most homeowners for they do not have to lift unneeded elements onto a roof. The roof tarp 60 further allows homeowners to patch barrel type tile roofs and flat roofs.

In a non-limiting exemplary embodiment, the roof tarp 60 includes body 50 having various shapes and sizes that has a top face and a bottom face. An adhesive tape 51 strip runs parallel and adhesively abuts all edges of the body 50. The adhesive strip is at least one-quarter inch in width from edge to edge of the roof tarp 60 and is at least 1/32 of an inch high from the bottom face of the roof tarp 60. A temporary cover is removably applied over the adhesive tape 51 strips. The bottom face of tape 51 is initially placed over the damaged roof tiles 53, then the temporary cover is removed from the bottom face of the adhesive tape 51 strips. Pressure is applied to the top face of the roof tarp 60 at locations immediately above the adhesive tape 51 strip so that the adhesive adheres to the roof and deformably conforms to the contour of the roof In a non-limiting exemplary embodiment, through experimental adhesive tape testing, a specially configured adhesive tape(s) 51, 52 was determined to provide adequate adhesive properties that overcome the aforementioned shortcomings of the conventional roof tarps 60. The combination of the heat-shrinkable tarp 60 and adhesive tape 51 provides a new, useful, and unexpected result of preventing water from flowing beneath the tarp 60 after installation.

In a non-limiting exemplary embodiment, the structural configuration of the heat-shrinkable body 50 and adhesive tape(s) 51, 52 provides the new, useful, and unexpected results of: facilitating shrink-wrap roof installation by fewer people than four people; providing a tarping system that can last at least one year; providing a tarping system that does not require all of the equipment needed for shrink wrap installation; providing a tarping system that is less dangerous than shrink wrapping; providing a tarping system that is fastened to the roof in a way that does not cause further damage to the roof and providing a tarping system that is installed to portions of the roof tile 53 instead of having to cover the entire roof.

In a non-limiting exemplary embodiment, testing the adhesive abilities of the tape(s) 51, 52 found that it was stronger than conventional adhesive tapes. Through these tests, it was determined that the present disclosure resolves the shortcomings of conventional shrink-wrap installation on roof tiles 53, without giving up the qualities that made shrink wraps far superior to blue tarps 60. The present disclosure provides a sustainable solution to cover a damaged area on a tile roof, shingle roof, or flat roof.

In a non-limiting exemplary embodiment, the some of the objectives of this disclosure is to: eliminate the need of using contractors to place an emergency blue tarp 60 on a damaged roof; minimize the cost incurred when temporarily patching a roof; minimize the supplies needed to temporarily patch a roof; provide a tarp 60 kit that can easily be lifted and carried up to a damaged roof; provide a tarp 60 kit that can be joined together easily to provide an unlimited amount of possibilities for covering multiple damaged areas and/or to cover the entire roof; provide a tarp 60 kit that can be cut and custom-shaped to any desired situation by using a disposable razor/cutter and extra four-inch adhesive tape(s) 51, 52; minimize the damage incurred when securing/fastening a tarp 60 on a damaged roof; provide a tarp 60 kit that has the ability to be custom fit and seal around protruding objects on the roof such as vents, pipes etc.; provide a tarp 60 kit that can be applied to a shingle roof; provide a tarp 60 kit that can be applied to a barrel tile roof; provide a tarp 60 kit that can be applied to a flat roof; provide a tarp 60 kit that can be applied to a metal roof, and a variety of other roofs.

In a non-limiting exemplary embodiment, a protective roof tarp 60 kit can include a heat-shrinkable tarp 60, double-sided adhesive tape 51, single-sided adhesive tape 52, and/or a cutting implement.

In a non-limiting exemplary embodiment, the present disclosure may be commercialized under the trademark SMART-TARP™ or a similar mark. The present disclosure employs viscoelastic polymer adhesive tape(s) 51, 52 to ensure the shrink-wrap body 50 adequately adheres to a variety of roof surfaces includes flat roofs containing granules 54 thereon. Through the use of this viscoelastic polymer (self-penetrating and priming) adhesive technology, this tape(s) 51, 52 provides a multifunctional, all in one, easy to use product for residential, commercial and industrial applications. Such a viscoelastic polymer tape(s) 51, 52 is ideal for use on roofs, gutters, skylights, windows, doors, flashings, walls, foundations, and many other surfaces. The viscoelastic polymer tape(s) 51, 52 will immediately seal materials stopping infiltration of leaks from air, moisture and water. The viscoelastic polymer tape(s) 51, 52 adheres to a variety of surface including metal, wood, fiberglass, plastic, structural concrete, concrete block, brick, smooth BUR, smooth SBS, smooth APP, EPDM, TPO, Hypalon and PVC surfaces. The viscoelastic polymer tape(s) 51, 52 is easy to apply, forms an incredibly tough and durable bond. Notably, the structural configuration (e.g., dimensions) of the viscoelastic polymer tape(s) 51, 52 has been modified to provide the desired new, useful, and unexpected results of maintaining a water-proof engagement with the top surface of root tiles (especially flat roof tiles 53 having granules 54 thereon).

In a non-limiting exemplary embodiment, the viscoelastic polymer tape(s) 51, 52 uses blocks UV degradation, increases waterproofing characteristics and stands up to ice and snow.

In a non-limiting exemplary embodiment, the viscoelastic polymer tape(s) 51, 52 employed by the present disclosure includes: ethylhexyl acrylate, butyl acrylate, methyl acrylate, butyl methacrylate, acrylate polymer, rubber, either natural rubber or synthetic thermoplastic elastomer, silicone rubber, and others. A mixture of these materials are blended with a tackifier to produce permanent tack ("grabbing power"). The high tack material is a polymer with low glass transition temperature and high entanglement molecular weight, whereas the low tack polymer has high glass transition temperature and low entanglement molecular weight.

In a non-limiting exemplary embodiment, the viscoelastic polymer adhesive tape(s) 51, 52 is non-flammable.

Referring to FIGS. 1-46 in general, a protective roof tarp 60 for being positioned on top of an existing roof surface 53 (e.g., roof tile, asphalt shingle, etc.) is disclosed. The protective roof tarp 60 includes a single and continuous body 50 having a top face, a bottom face, and a plurality of edges. Advantageously, the body 50 is water-impermeable and includes heat-shrink material configured to morph and deform to the top contour of the existing roof surface. A first adhesive tape 51 is attached to the bottom face and extended along the edges of the body 50. Advantageously, the body 50 includes a flexible impermeable sheet configured to be positioned along a top contour of the existing roof surface 53. Advantageously, the first adhesive tape 51 has a thickness suitably sized and shaped to deformably conform to the top contour of the existing roof surface 53 and thereby prohibit water from accessing the existing roof surface 53. Such a structural configuration yields the new, useful, and unexpected results of a heat-shrinkable impermeable body 50 having superior adhesion to various roof contours including around vent pipe boots for a better repair.

Figure 44:
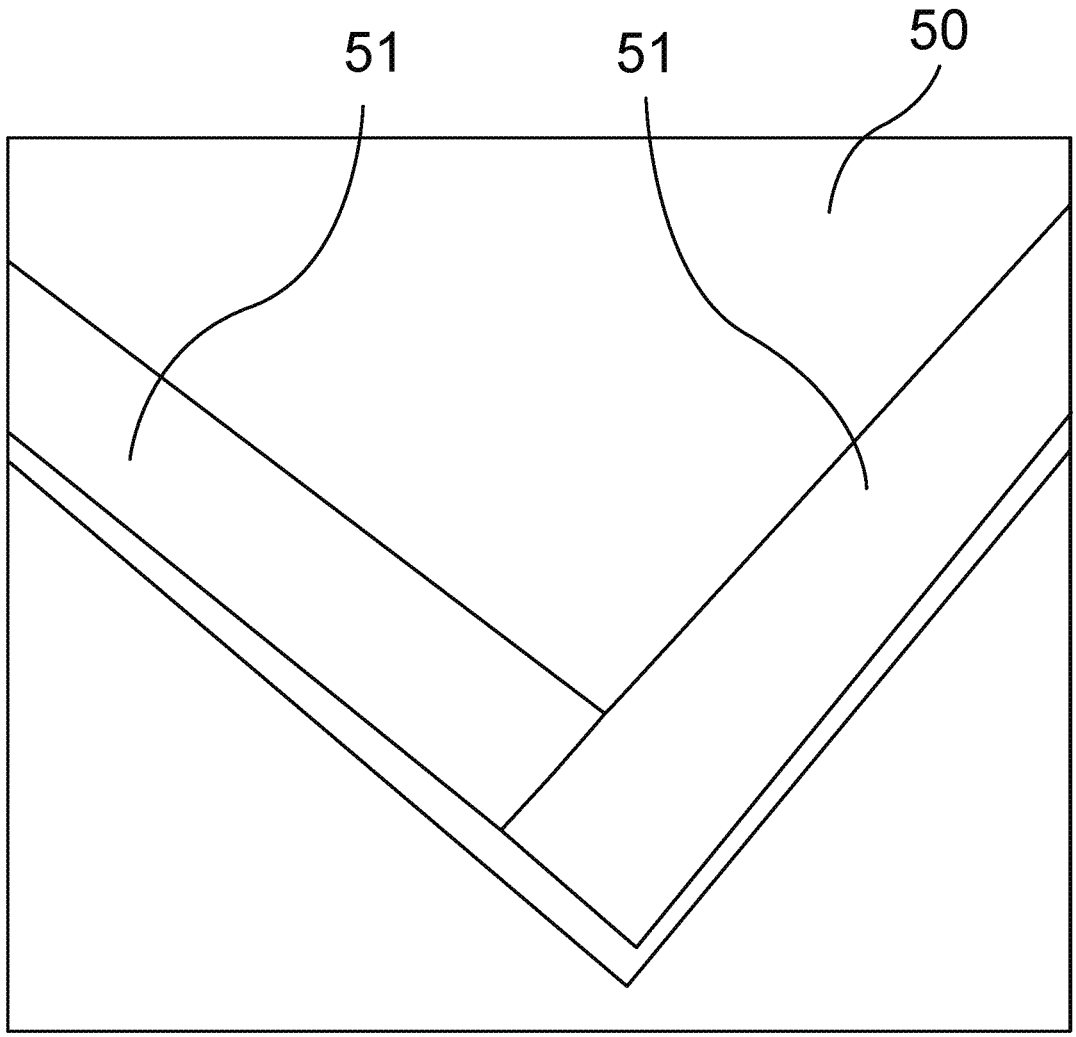
FIG. 44 is an enlarged bottom perspective view of the protective roof tarp shown in FIG. 40, in accordance with a non-limiting exemplary embodiment of the present disclosure.
Figure 45:
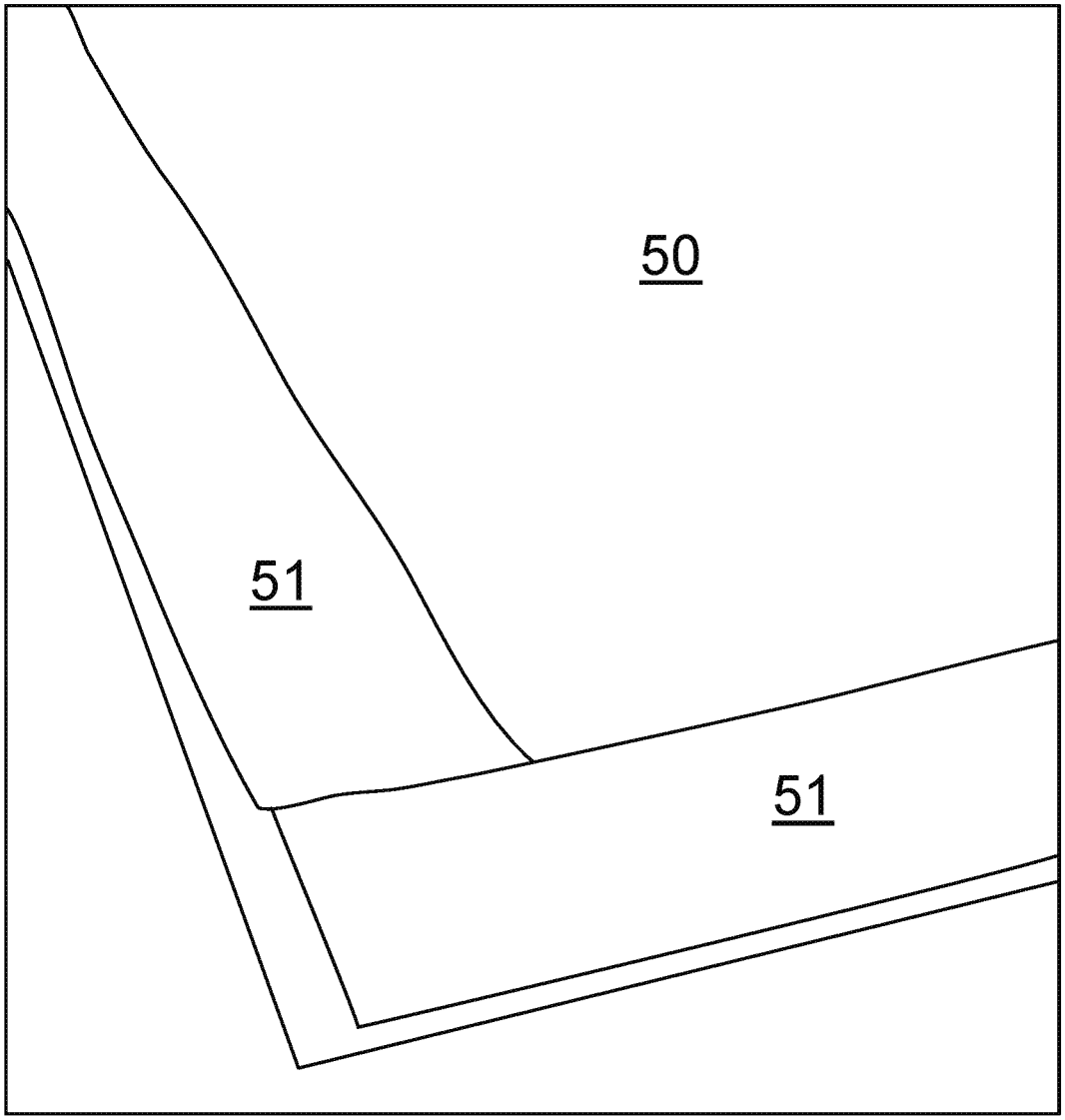
FIG. 45 is an enlarged bottom perspective view of the protective roof tarp shown in FIG. 40, in accordance with a non-limiting exemplary embodiment of the present disclosure.
Figure 46:
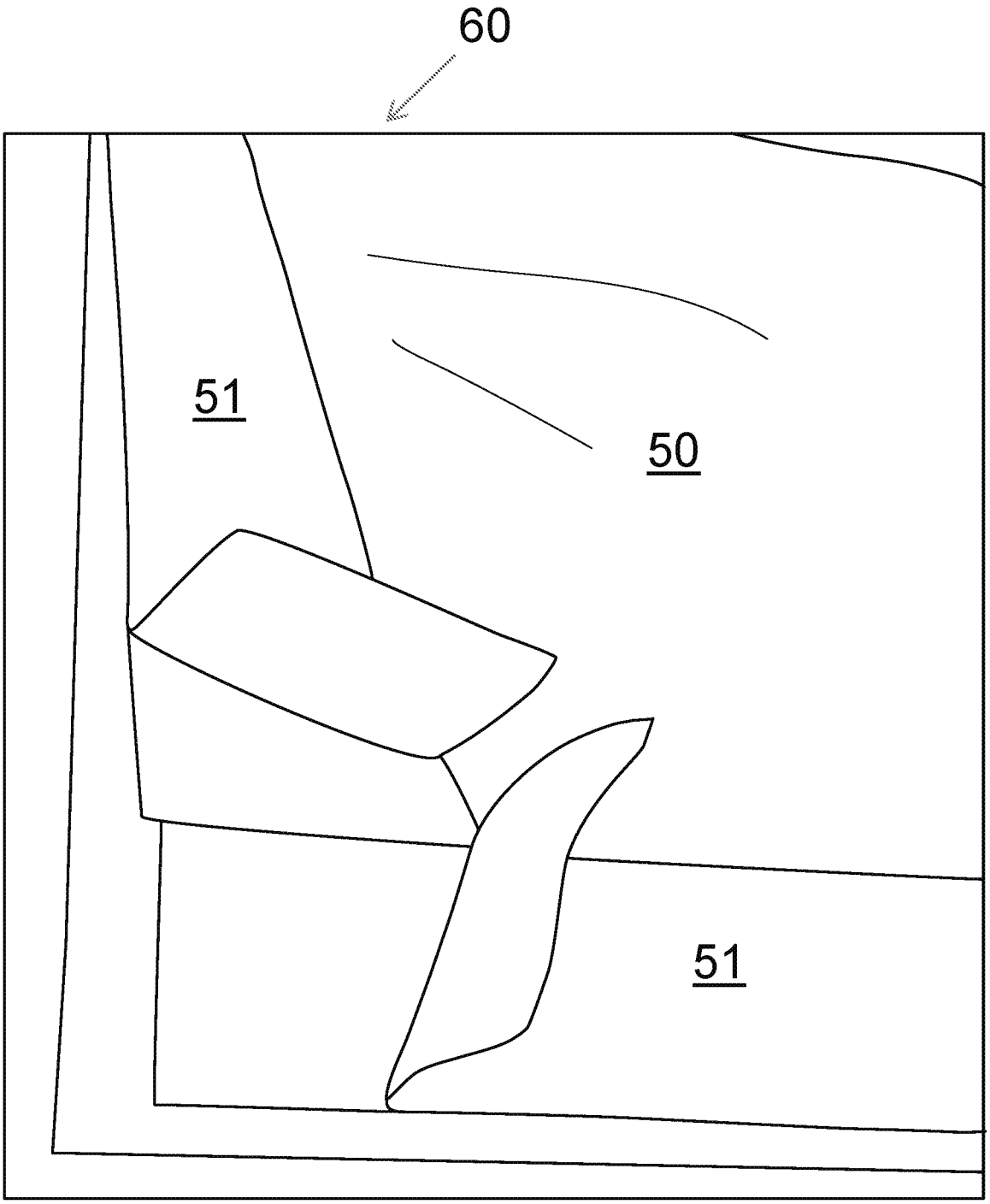
FIG. 46 is an enlarged bottom perspective view of the protective roof tarp shown in FIG. 40, in accordance with a non-limiting exemplary embodiment of the present disclosure.

In a non-limiting exemplary embodiment, as perhaps best shown in FIGS. 44-46, the first adhesive tape 51 is flexible, pliable, and deformably resilient such that a cross-sectional thickness of the first adhesive tape 51 is decreased when an external force is exerted thereagainst. Such a structural configuration yields the new, useful, and unexpected results of a heat-shrinkable impermeable body 50 having superior adhesion to various roof contours including around vent pipe boots for a better repair.

In a non-limiting exemplary embodiment, the first adhesive tape 51 includes a plurality of first adhesive tape 51 strips arranged in an end-to-end pattern. Each of the first adhesive tape 51 strips has a longitudinal length less than a longitudinal length of an associated one of the edges. Such a structural configuration yields the new, useful, and unexpected results of a heat-shrinkable impermeable body 50 having superior adhesion to various roof contours including around vent pipe boots for a better repair.

In a non-limiting exemplary embodiment, the first adhesive tape 51 is spaced inwardly of the edges of the body 50. Such a structural configuration yields the new, useful, and unexpected results of a heat-shrinkable impermeable body 50 having superior adhesion to various roof contours including around vent pipe boots for a better repair.

In a non-limiting exemplary embodiment, the first adhesive tape 51 is not visible to a line of sight taken from a top face of the body 50. Such a structural configuration yields the new, useful, and unexpected results of a heat-shrinkable impermeable body 50 having superior adhesion to various roof contours including around vent pipe boots for a better repair.

In a non-limiting exemplary embodiment, the first adhesive tape 51 has a top surface attached to the bottom face of the body 50. Such a structural configuration yields the new, useful, and unexpected results of a heat-shrinkable impermeable body 50 having superior adhesion to various roof contours including around vent pipe boots for a better repair.

In a non-limiting exemplary embodiment, the first adhesive tape 51 has a bottom surface attached directly to the top contour of the existing roof surface 53. Advantageously, an entire surface area of the top surface of the first adhesive tape 51 is continuously affixed to the bottom face of the body 50. Such a structural configuration yields the new, useful, and unexpected results of a heat-shrinkable impermeable body 50 having superior adhesion to various roof contours including around vent pipe boots for a better repair.

In a non-limiting exemplary embodiment, an entire surface area of the bottom surface of the first adhesive tape 51 is continuously affixed directly to the top contour of the existing roof surface 53. Such a structural configuration yields the new, useful, and unexpected results of a heat-shrinkable impermeable body 50 having superior adhesion to various roof contours including around vent pipe boots for a better repair.

In a non-limiting exemplary embodiment, a second adhesive tape 52 is provided and attached to the top surface and extended along the edges of the body 50. In this manner, the body 50 is intercalated between the first adhesive tape 51 and the second adhesive tape 52 such that the first adhesive tape 51 is spaced from the second adhesive tape 52. Such a structural configuration yields the new, useful, and unexpected results of a heat-shrinkable impermeable body 50 having superior adhesion to various roof contours including around vent pipe boots for a better repair.

Figure 39:
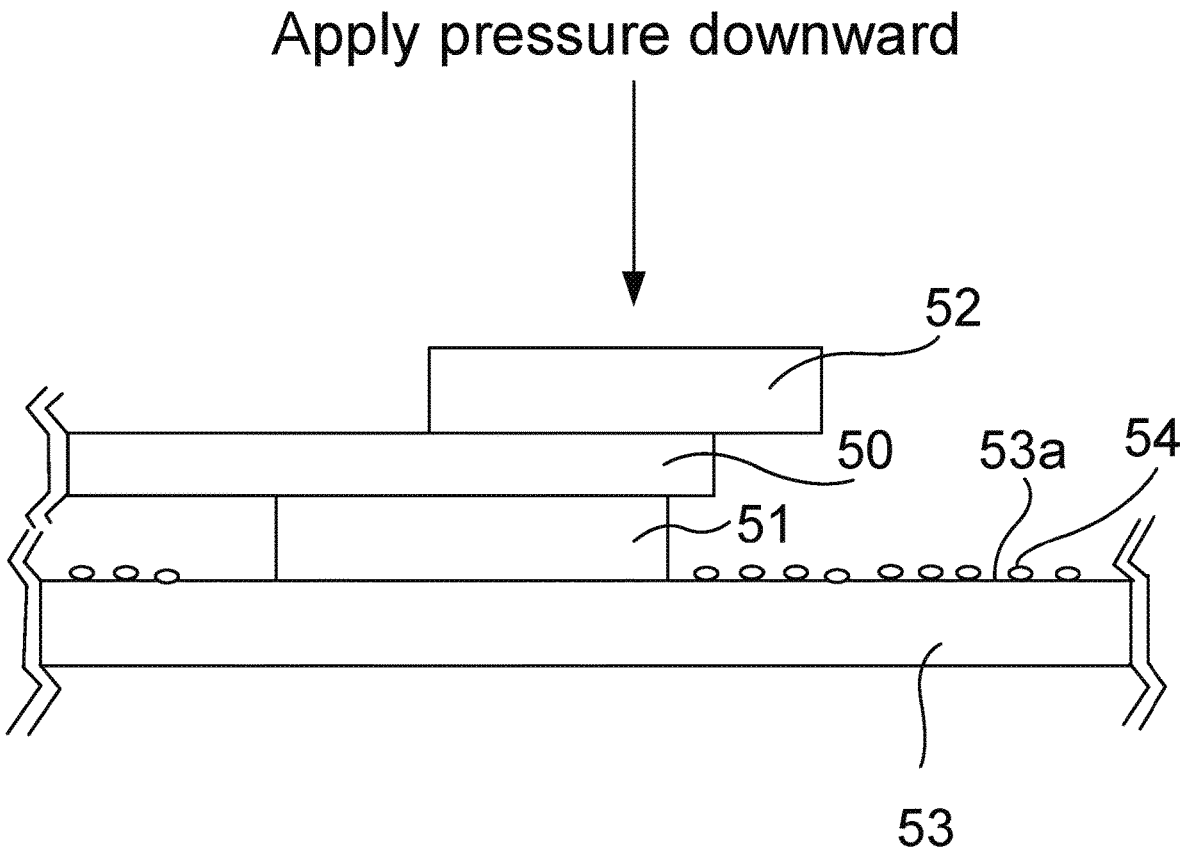
FIG. 39 is a side elevational view of the protective roof tarp affixed to roof shingles having granules, in accordance with a non-limiting exemplary embodiment of the present disclosure.
Figure 40:
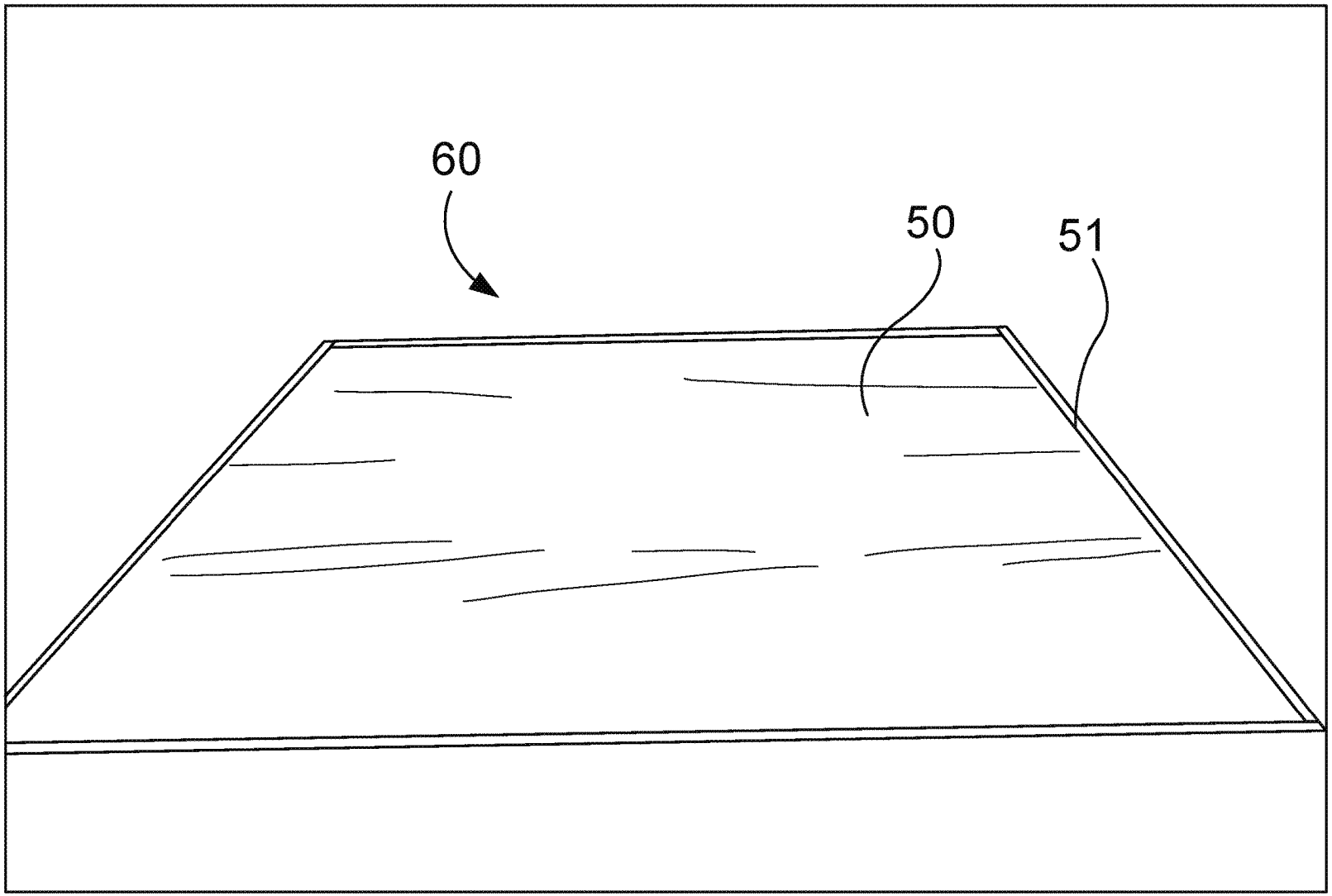
FIG. 40 is a perspective view of the protective roof tarp, in accordance with a non-limiting exemplary embodiment of the present disclosure.
Figure 41:
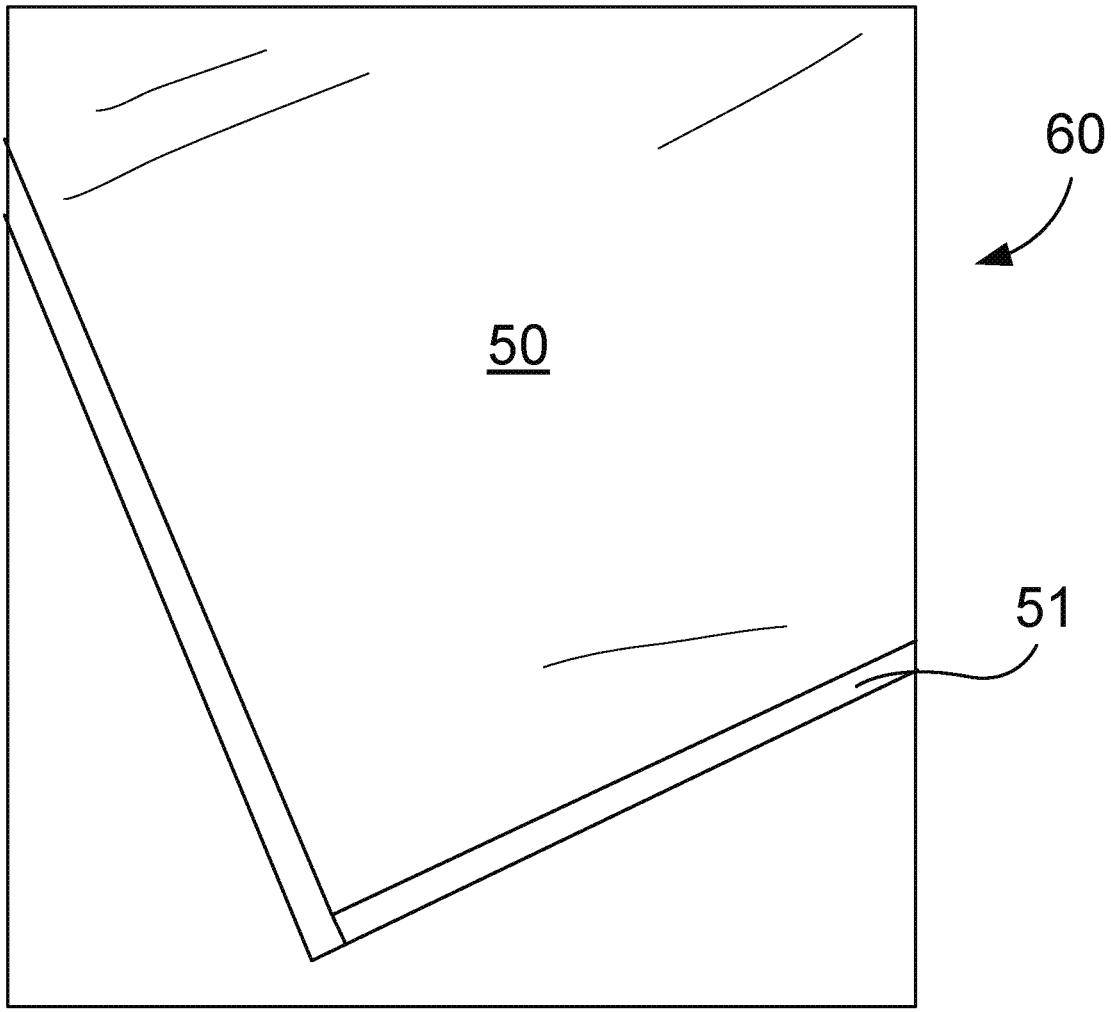
FIG. 41 is a bottom perspective view of the protective roof tarp, in accordance with a non-limiting exemplary embodiment of the present disclosure.
Figure 42:
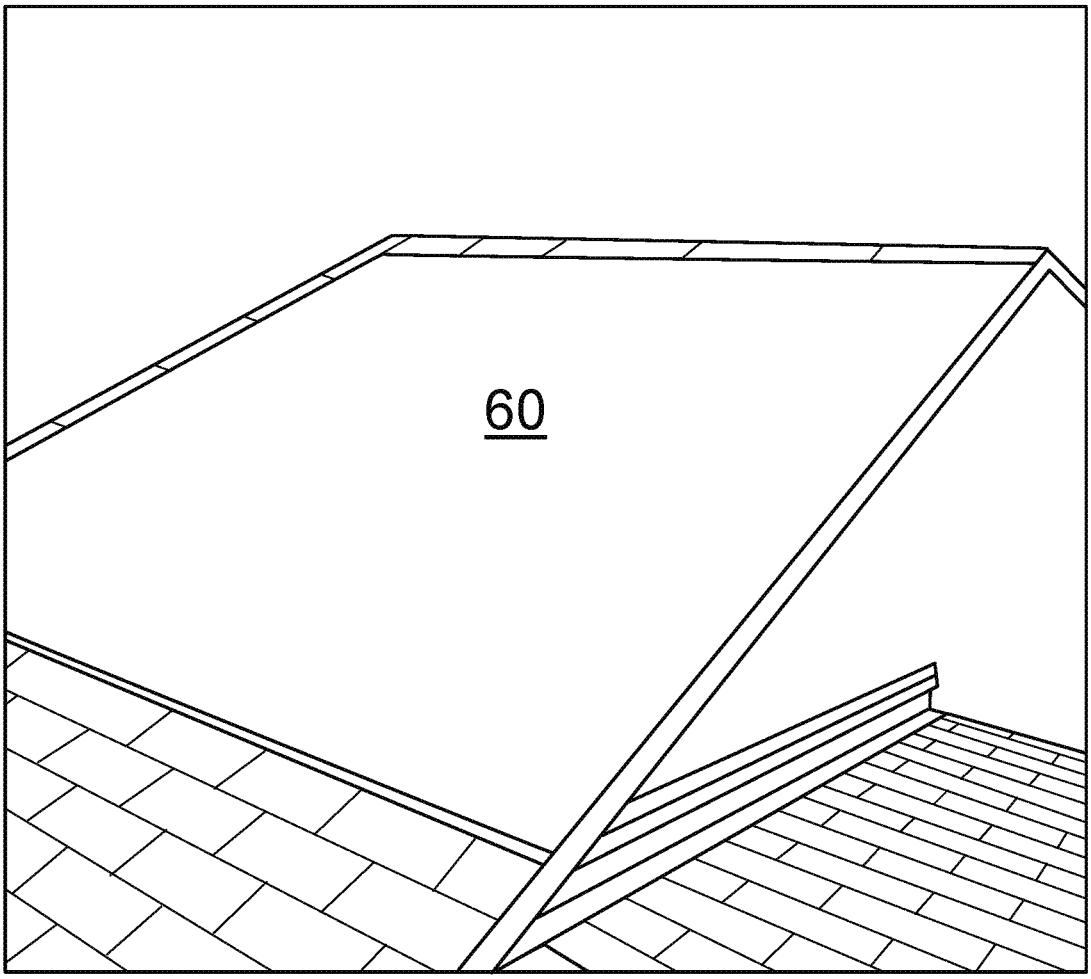
FIG. 42 is a perspective view of the protective roof tarp, in accordance with a non-limiting exemplary embodiment of the present disclosure.
Figure 43:
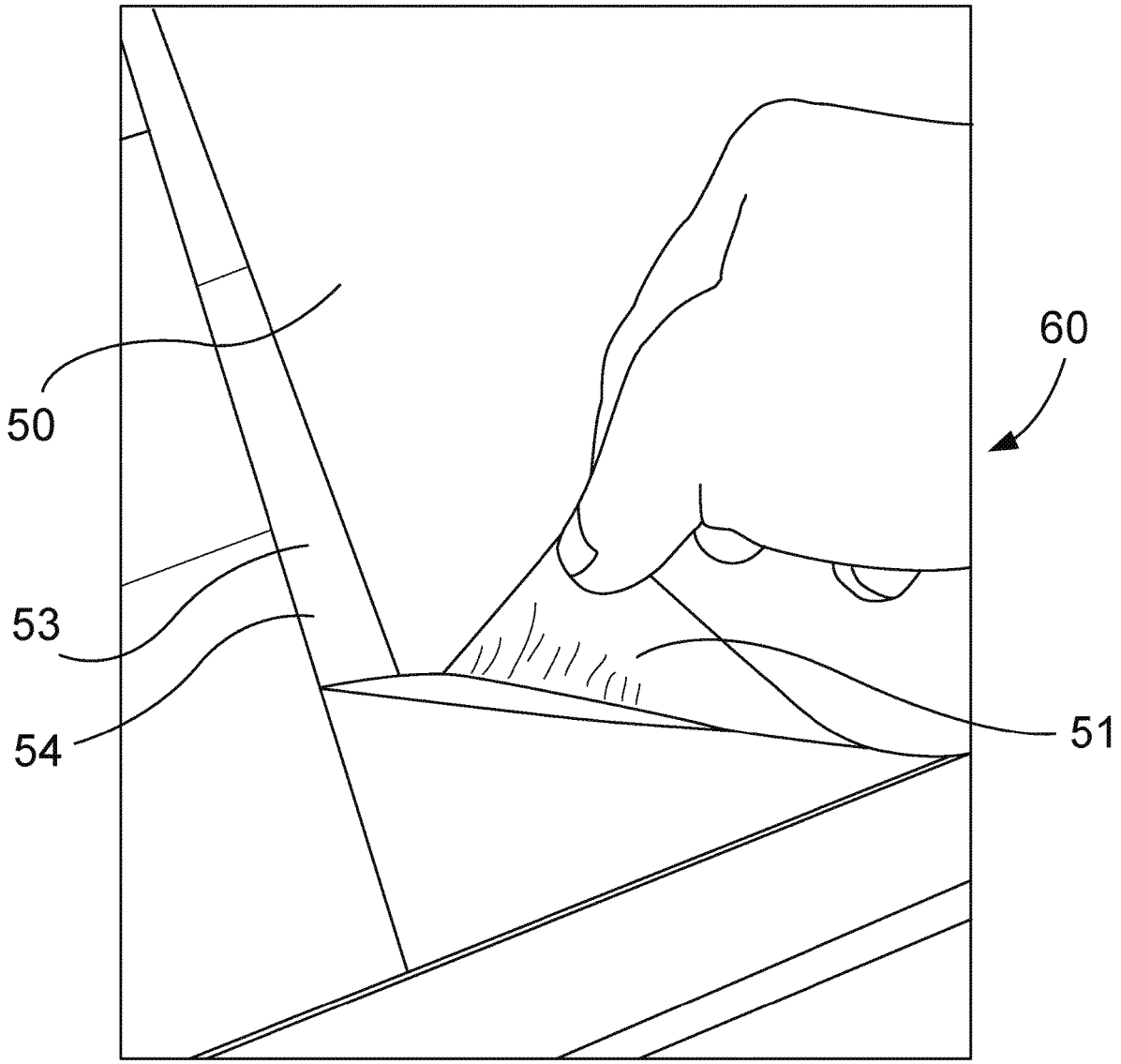
FIG. 43 is an enlarged perspective view of a corner of the protective roof tarp shown in FIG. 42 wherein the adhesive tape has bonded with the roof tile, in accordance with a non-limiting exemplary embodiment of the present disclosure.

In a non-limiting exemplary embodiment, a first adhesive tape 51 may be double-sided and applied on a bottom face of the tarp 60. A second adhesive tape 52 is single-sided and applied on a top face of the tarp 60. The first adhesive tape 51 remains spaced from the second adhesive tape 52 such that the tarp 60 is intercalated between the first adhesive tape 51 and the second adhesive tape 52. FIG. 39 shows a side elevational view of structural configuration of the tarp 60 prior to being pressed down and adhesively secured to the top surface of the roof tile 53 having granules 54. When the body 50 is affixed to the roof tile 53 the double-sided first adhesive layer 51 and single-sided second adhesive layer 52 are deformably pressed down to conform to the contour of the roof tile 53 shape thereby passing the granules 54 and directly engaging the roof tile top surface 53*a* to maintain a secure water-impermeable engagement for extended periods of time.

In a non-limiting exemplary embodiment, the viscoelastic polymer adhesive tape may be manufactured by Gardner-Gibson, Inc. and sold on the website www.APOC.com. Such a viscoelastic polymer adhesive tape is preferably double-sided and may be available under the brand name INCREDIBLE™. The viscoelastic polymer adhesive tape may have a double bond, 60 millimeters sealant; AP-0002-DB. For example, the adhesive tape may be APOC™ FLEECE-TOP™ heavy-duty, all-purpose tape and sealant.

In a non-limiting exemplary embodiment, as shown in FIGS. 1-46, the protective roof tarp 60 include of various shapes and sizes. The tarp 60 has a top face and a bottom face. An adhesive strip is permanently attached to the bottom face of roof tarp 60 and runs parallel around entire perimeter. As shown in figures, the adhesive strip runs parallel to the edge of the roof tarp 60 and must be at a height from the top face of the roof tarp 60 that is at enough height for it to contour to any roofing material and to form a complete bond. In particular, the thickness of at least one of the adhesive tapes 51, 52 is preferably between 40-100 millimeters thick to adequately deform and pass by the granules 54 on a flat asphalt roof shingle thereby directly engaging a substrate of the flat asphalt roof shingle. A temporary protective cover strip is removably attached to the adhesive strip and removed prior to installation.

In a non-limiting exemplary embodiment, the body 50 of roof tarp 60 can be made only of a heat-shrinkable substance created in a solid form (e.g., no weaving that is found in conventional blue tarps).

In a non-limiting exemplary embodiment, a method of using the tarp 60 includes the steps of: first lifting the roof tarp 60 onto a damaged roof; unfolding and placing the bottom face of the roof tarp 60 over the damaged area, keeping the center of the roof tarp 60 over the damaged area; spreading the roof tarp 60 out evenly and flat over roof; going to one corner of the roof tarp 60 and removing the protective cover strip from the adhesive tape 51 with an outward motion away from the roof tarp 60 thereby revealing a portion of adhesive tape 51.

In a non-limiting exemplary embodiment, the method further includes the steps of: while the cover strip is removed from underneath the roof tarp 60, placing the roof tarp 60 on top of the roof tile 53 in a straight and even fashion. Once this first initial placement is correctly done, continue pulling the cover strip(s) away from the roof tarp 60 and continue laying down all four sides of the roof tarp 60 while applying pressure to the top face of the roof tarp 60 directly above the adhesive strip(s) 51 of the roof tarp 60 so that the adhesive strip(s) 51 adheres to the top of roof tile 53 (and penetrates past the granules 54 on a flat asphalt roof tile 53 to directly engage the substrate of the flat asphalt roof tile 53).

In a non-limiting exemplary embodiment, the protective roof tarp 60 kit includes a self-adhesive tarp 60 (e.g., heat-shrinkable elastic membrane material), self-adhesive vent pipe boot, adhesive tape, and a razor blade if needed.

In a non-limiting exemplary embodiment, the protective roof tarp 60 was tested by pouring water on it after being installed on roof tile 53. No water leaks were detected, and the adhesive tape maintained a continuous water-proof engagement with the roof tile 53.

In a non-limiting exemplary embodiment, the roof tarp 60 material is made from a nonporous impenetrable 100% virgin polyethene/poly type substance that is created and manufactured in a solid form; not by weaving plastic products together.

In a non-limiting exemplary embodiment, another method of using the roof tarp 60 lifting includes the steps of: obtaining and placing at least two roof tarps 60 onto a damaged roof; positioning a bottom face of the first roof tarp 60 over the damaged area; removing a cover strip from a first adhesive tape 51 strip; and applying pressure to a top face of the first roof tarp 60 in a location immediately above the first adhesive tape 51 strip so that the first adhesive tape 51 strip adheres to the roof tile 53.

In a non-limiting exemplary embodiment, the method further includes the steps of: abutting one edge of the second roof tarp 60 to one edge of the first roof tarp 60 that is already installed on the roof tile 53; and installing the second roof tarp 60 on the roof tile 53 by repeating the same installation of the first roof tarp 60. Obtaining a one to four inch-wide section of a second adhesive tape 52; and applying the second adhesive tarp 60 to a top face of the abutted edges of the first roof tarp 60 and the second roof tarp 60 by removing a cover strip from the second adhesive tape 52 and applying pressure directly on top of a seam (abutted edges) of the first roof tarp 60 and the second roof tarp 60.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A protective roof tarp for being positioned on top of an existing roof surface, comprising:

a body having a top face, a bottom face, and a plurality of edges; and a first adhesive tape attached to said bottom face and extended along said edges of said body;

wherein said body includes a flexible, non-woven, impermeable sheet configured to be positioned along a top contour of the existing roof surface;

wherein said first adhesive tape has a thickness configured to deformably conform to the top contour of the existing roof surface and thereby prohibit water from accessing the existing roof surface;

wherein said body is water-impermeable and includes heat-shrink material configured to morph and deform to the top contour of the existing roof surface;

wherein said first adhesive tape is a viscoelastic polymer adhesive tape;

wherein said thickness of said first adhesive tape is at least 40 millimeters and configured to deform and pass by existing roof shingle granules on a flat asphalt roof shingle of the existing roof surface and further configured to engage a substrate of the flat asphalt roof shingle;

wherein said body does not contain woven material.

2. The protective roof tarp of claim 1, wherein said first adhesive tape is flexible and deformably resilient such that a cross-sectional thickness of said first adhesive tape is decreased when an external force is exerted thereagainst; wherein said thickness of said first adhesive tape is less than 100 millimeters.

3. The protective roof tarp of claim 2, wherein said first adhesive tape includes a plurality of first adhesive tape strips arranged in an end-to-end pattern, each of said first adhesive tape strips having a longitudinal length less than a longitudinal length of an associated one of said edges.

4. The protective roof tarp of claim 3, wherein said first adhesive tape is spaced inwardly of said edges of said body.

5. The protective roof tarp of claim 4, wherein said first adhesive tape is not visible to a line of sight taken from a top face of said body.

6. The protective roof tarp of claim 5, wherein said first adhesive tape has a top surface attached to said bottom face of said body.

7. The protective roof tarp of claim 6, wherein said first adhesive tape has a bottom surface attached directly to the top contour of the existing roof surface, wherein an entire surface area of said top surface of said first adhesive tape is continuously affixed to said bottom face of said body.

8. The protective roof tarp of claim 7, wherein an entire surface area of said bottom surface of said first adhesive tape is continuously affixed directly to the top contour of the existing roof surface.

9. The protective roof tarp of claim 1, further comprising: a second adhesive tape attached to said top surface and extended along said edges of said body, wherein said body is intercalated between said first adhesive tape and said second adhesive tape, wherein said first adhesive tape is spaced from said second adhesive tape.

10. A protective roof tarp for being positioned on top of an existing roof surface, comprising:

a body having a top face, a bottom face, and a plurality of edges; and a first adhesive tape attached to said bottom face and extended along said edges of said body;

wherein said body includes a flexible, non-woven, impermeable sheet configured to be positioned along a top contour of the existing roof surface;

wherein said first adhesive tape has a thickness configured to deformably conform to the top contour of the existing roof surface and thereby prohibit water from accessing the existing roof surface;

wherein said body is water-impermeable and includes heat-shrink material configured to morph and deform to the top contour of the existing roof surface;

wherein said body is single and continuous;

wherein said first adhesive tape is a viscoelastic polymer tape including a mixture of ethylhexyl acrylate, butyl acrylate, methyl acrylate, butyl methacrylate, acrylate polymer, and rubber.

wherein said thickness of said first adhesive tape is at least 40 millimeters and configured to deform and pass by existing roof shingle granules on a flat asphalt roof shingle of the existing roof surface and further configured to engage a substrate of the flat asphalt roof shingle;

wherein said body is single, solid, continuous and does not contain weaves.

11. The protective roof tarp of claim 10, wherein said first adhesive tape is flexible and deformably resilient such that a cross-sectional thickness of said first adhesive tape is decreased when an external force is exerted thereagainst; wherein said thickness of said first adhesive tape is less than 100 millimeters.

12. The protective roof tarp of claim 11, wherein said first adhesive tape includes a plurality of first adhesive tape strips arranged in an end-to-end pattern, each of said first adhesive tape strips having a longitudinal length less than a longitudinal length of an associated one of said edges.

13. The protective roof tarp of claim 12, wherein said first adhesive tape is spaced inwardly of said edges of said body.

14. The protective roof tarp of claim 13, wherein said first adhesive tape is not visible to a line of sight taken from a top face of said body.

15. The protective roof tarp of claim 14, wherein said first adhesive tape has a top surface attached to said bottom face of said body.

16. The protective roof tarp of claim 15, wherein said first adhesive tape has a bottom surface attached directly to the top contour of the existing roof surface, wherein an entire surface area of said top surface of said first adhesive tape is continuously affixed to said bottom face of said body.

17. The protective roof tarp of claim 16, wherein an entire surface area of said bottom surface of said first adhesive tape is continuously affixed directly to the top contour of the existing roof surface.

18. The protective roof tarp of claim 10, further comprising: a second adhesive tape attached to said top surface and extended along said edges of said body, wherein said body is intercalated between said first adhesive tape and said second adhesive tape, wherein said first adhesive tape is spaced from said second adhesive tape.

* * * * *